US005857677A

United States Patent [19]

Sum Chau

[11] Patent Number: 5,857,677

[45] Date of Patent: Jan. 12, 1999

[54] GAME SET WITH GAME PIECES BEARING INDICIA AND A METHOD OF PLAYING THE SAME

[76] Inventor: Danny Ping Sum Chau, 9712 Cortada St., El Monte, Calif. 91733

[21] Appl. No.: 820,807

[22] Filed: Mar. 19, 1997

Related U.S. Application Data

[63] Continuation-in-part of Ser. No. 531,519, Sep. 21, 1995, abandoned.

[51] Int. Cl.[6] ..... A63F 1/00

[52] U.S. Cl. ..... 273/292; 273/274; 273/306

[58] Field of Search ..... 273/292, 274, 273/290, 303, 304, 306

[56] References Cited

U.S. PATENT DOCUMENTS

| | | | |
|---|---|---|---|
| 1,600,108 | 9/1926 | Gell | 273/300 |
| 2,265,334 | 12/1941 | Armbruster | 273/299 |
| 3,215,435 | 11/1965 | Rheingruber | 273/DIG. 27 |
| 3,680,866 | 8/1972 | Kerr | 273/DIG. 27 |
| 4,428,582 | 1/1984 | Smith | 273/299 |
| 5,248,142 | 9/1993 | Breeding | 273/274 |
| 5,314,194 | 5/1994 | Wolf | 273/292 |
| 5,397,128 | 3/1995 | Hesse et al. | 273/274 |

*Primary Examiner*—William M. Pierce
*Attorney, Agent, or Firm*—Ladas & Parry

[57] ABSTRACT

The present invention is a game that pits a Dealer against other players. The game uses two sets of game pieces (tiles or cards). According to a first game variation, each of a first set of game pieces contains a symbol or symbols that represent a high deuce and a low deuce, the highest individually ranking game pieces in this game. The remaining game pieces contain numeric values of between 0 and 9. The Dealer and each of the Players randomly received four game pieces into which they arrange two hands of two cards each. The Dealer's higher hand, according to a ranking system, is compared to the higher hand of each of the Players. The Dealer's lower hand is compared to the lower hand of the Players. To win, a Dealer or Player must win both hands. According to a second game variation, the first set of game pieces comprises a pair of "Joker"s instead of high deuce and low deuce symbols.

4 Claims, 20 Drawing Sheets

FIG.11C
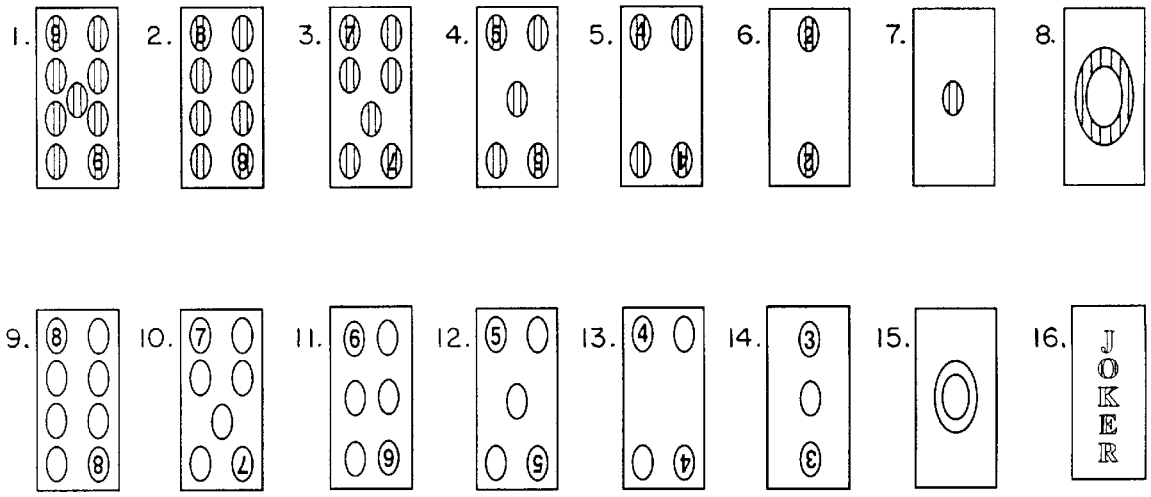
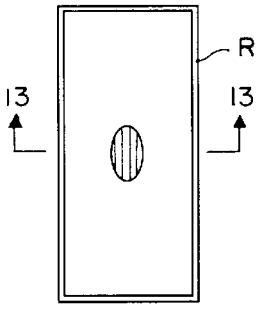
FIG.12
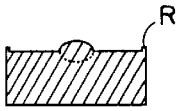
FIG.13

GAME SET WITH GAME PIECES BEARING INDICIA AND A METHOD OF PLAYING THE SAME

CROSS REFERENCE TO RELATED APPLICATIONS

This application is a Continuation-In-Part application of U.S. Ser. No. 08/531,519 filed Sep. 21, 1995, now abandoned.

BACKGROUND OF THE INVENTION

1. Field of the Invention

This invention pertains to a game played with tiles (or cards). More particularly, the game according to this invention may be played with two to eight players, one of whom acts as a dealer. The objective of the game is for players to arrange their cards into hands that have a higher ranking than that of the dealer.

2. Brief Description of the Prior Art

The game of "Pai Gow" is representative of the prior art pertaining to the type of game of the present invention. Pai Gow, likely the forerunner of what is known in the United States as "dominoes", is an ancient Chinese game played in many Asian countries. It is fast paced, exciting, perfectly adapted for wagering, and requires both luck and experience to play. Pai Gow uses 32 dominoes, each of which has two to twelve dots. Each player is dealt four of the tiles. From these four tiles, a player forms two "hands", a high hand and a low hand, each hand comprising two tiles. The object of the game is to obtain a high hand that ranks higher than the dealer's high hand, and a low hand that ranks higher than the dealer's low hand. To win, a player must prevail in both hand comparisons.

Pai Gow can be played at home but has become a popular game in casinos throughout the world. Most major Las Vegas and Atlantic City hotels have at least one Pai Gow table going at any given time. The game is also played in casinos in other states that have legalized gambling. However Pai Gow is not an easy game to learn because its ranking system for prevailing hands is not based on a logical mathematical sequential progression. The domino values represent not so much numbers as they represent Chinese symbols for concepts or objects such as "double heaven" or "double earth". For example, the highest hand in Pai Gow is the "Supreme" combination of the three-dot tile and a six dot tile. This hand is superior to the next ranking hand of a pair of twelve-dot tiles, otherwise known as "Double Heaven". In the comparison of these two described hands, a pair of identical tiles does not necessarily outrank two tiles that are not identical (two tiles that do not form a pair).

To further illustrate the complexities of the prior art game, the third highest possible hand is comprised of a pair of identical two-dot tiles. The fourth highest possible hand consists of a pair of identical eight-dot tiles. Thus, while a pair of identical twelve-dot tiles (the second highest possible hand) defeats a pair of identical two-dot tiles, the latter prevails over a pair of identical eight-dot tiles. Therefore one cannot gauge a winning hand by its numerical magnitude, because the pairs do not follow a number sequence from highest to lowest or vice versa. Persons unfamiliar with the rules become further perplexed when "mixed" hands, combining non-identical tiles, are played without regard to a rational set of rules based on the numerical value of dots or dot combinations. For example, a combination of a two-dot tile and a nine-dot tile defeats a hand comprising a twelve-dot tile and an eight-dot tile.

The difficulty of learning Pai Gow is compounded by the use of red and white dots to represent tile values. While an experienced player may know the value of the dotted-tiles at a glance, less experienced players will need precious time to "count" the dots, time that may be more advantageously used to arrange the tiles into the most beneficial combinations.

Because of the complex and irrational ranking system of Pai Gow, the players at the Pai Gow tables found in the United States tend to be overwhelmingly Asians who have played this game for a long time. Non-Asians and Asians who are inexperienced in this game do not play, or even bother to learn, the game because they are intimidated by the illogical rules for ranking, the fast pace of the playing, and the substantial amount of time it would take to learn the game.

SUMMARY OF THE INVENTION

The present invention is a game that, like Pai Gow, is exciting and well-suited to wagering dynamics. However, it presents a number of major differences that will make it easier to learn and play and therefore should make it more popular with the general public. First, unlike the ancient game, the present invention uses tiles that are easier to read. Instead of using tiles that bear dots that represent Chinese characters, the tiles or cards of the present game use alphanumeric characters. The alphanumeric characters are much easier to read and comprehend. Second, the, present invention involves a ranking system that is far superior to that used in Pai Gow, because it is based on a progressive ranking sequence that is, for the most part, rational and easily comprehensible. In the description, the terms "cards" and "game pieces" may be used interchangeably, and it is to be understood that the game pieces having indica on them may take on a number of forms, domino-like or tile-like pieces being the preferred choices. When convenient, the term tile(s) will be used throughout this description as being representative only of any number of game piece or card configurations.

GAME 1 (FIGS. 1–5)

This game uses two sets of tiles. The first set of tiles have a symbol or symbols thereon that represent a high deuce and a low deuce, the highest individually ranking cards in this game. The high and low deuces may be represented by the letters A and B respectively, two red and two white dots respectively, or some other configuration. The tiles of the second set have numeric characters thereon. In pair combinations, the highest hand combinations after the high deuce pair of "A"s and the low deuce pair of "B"s is a pair of identical red "8"s, followed by a pair of identical red "7"s, a pair of identical red "6"s, etc. In other words, the ranking system is, in large part, based on a rational sequential progression. After the identical-pair combinations, mixed hands are also logic-based. For example, the next highest hand would be a high deuce combined with the highest numeric tile. The next highest hand would be the low deuce combined with the highest numeric tile. The next highest hand would be a high deuce teamed with a second highest numeric tile, etc.

Ideally, play takes place between a "dealer" or "banker" and each of the other individual players in the game. The tiles (or cards) are dealt based on a random indicator, such as the tossing of dice. Four cards are dealt to each player, including the dealer. In places where it is legal to gamble, bets may be placed. Players form two hands of two tiles each. A player's highest hand is compared to the dealer's highest hand. Then a player's lowest hand is compared with the dealer's lowest hand. For the dealer to win, he or she must win both hands. For a player to win, he or she must win both hands. If a player wins one hand and loses the other, the game is a push. Ties between high hands go to the dealer. Similarly, ties between low hands also go the dealer. The house will collect a 5% commission on all winning bets.

GAME 2 (FIGS. 5–10)

This game, similar to GAME 1, uses two sets of tiles. The first set of tiles contains a pair of "Joker"s, the highest ranking tile pair in this game. The tiles of the second set have numeric characters thereon and are themselves grouped into a red number group and a white number group, any number of the red group outranking any number of the white group.

In pair combination, the highest hand combinations after the pair of "Joker"s is a pair of identical red "9"s, followed by a pair of identical red "8"s, a pair of identical red "7"s, etc. to the lowest ranking pair of white "0"s. In other words, the ranking system is, in large part, based on a rational sequential progression even simpler than that described in connection with GAME 1. More specifics as to pair ranking will be described hereinafter.

After the identical-pair combinations, mixed hands are also logic-based. For example, the next highest hand is a pair of numeric tiles totaling 9, again with the red numbers outranking the white numbers. The ranking order continues with the next highest hand being a pair of numeric tiles totaling 8, then a pair of tiles totaling 7, etc., again with the red numbers outranking the white numbers. Thus, after the identical-pair combinations, the next highest hand is a red "9"+red or white "1" or "Joker" (taking on a "0" value). The next highest ranking combination is a red "8"+red "1" (there is no white "1") or "Joker" (taking the value "1"), etc. to the lowest ranking nonidentical-pair combination consisting of tiles totaling 0 (i.e., a red "0"+white "0" pair, or number pairs totaling 10 with the tens digits dropped). Other combination ranking and tie rules apply as will be discussed in detail hereinafter.

In playing GAME 2, the dealing of the tiles, the number of tiles dealt, the House rules, and the general rules for winning hands are similar to those of GAME 1 described above.

Easy tile recognition combined with a progressive ranking system, and retention of some of the elements that make the ancient game of Pai Gow exciting, provide the present invention with the necessary ingredients to be a fast-action, dramatic, and, above all, easy to learn game.

BRIEF DESCRIPTION OF THE DRAWINGS

In describing the preferred embodiments of the invention, reference will be made to the accompanying drawings, wherein the color lining represents the color red, and:

FIG. 11C is a view of the ranking of single value game pieces showing, in order, the highest ranking single tile to the lowest ranking single tile employing a preferred design style taken from the alternate design styles shown in FIG. 11A;

FIG. 12 shows a tile with a projecting dot and a ridge around the tile; and

FIG. 13 is a cross sectional view taken along the line 13—13 in FIG. 12.

DETAILED DESCRIPTION OF THE PREFERRED EMBODIMENTS

Figure 1:
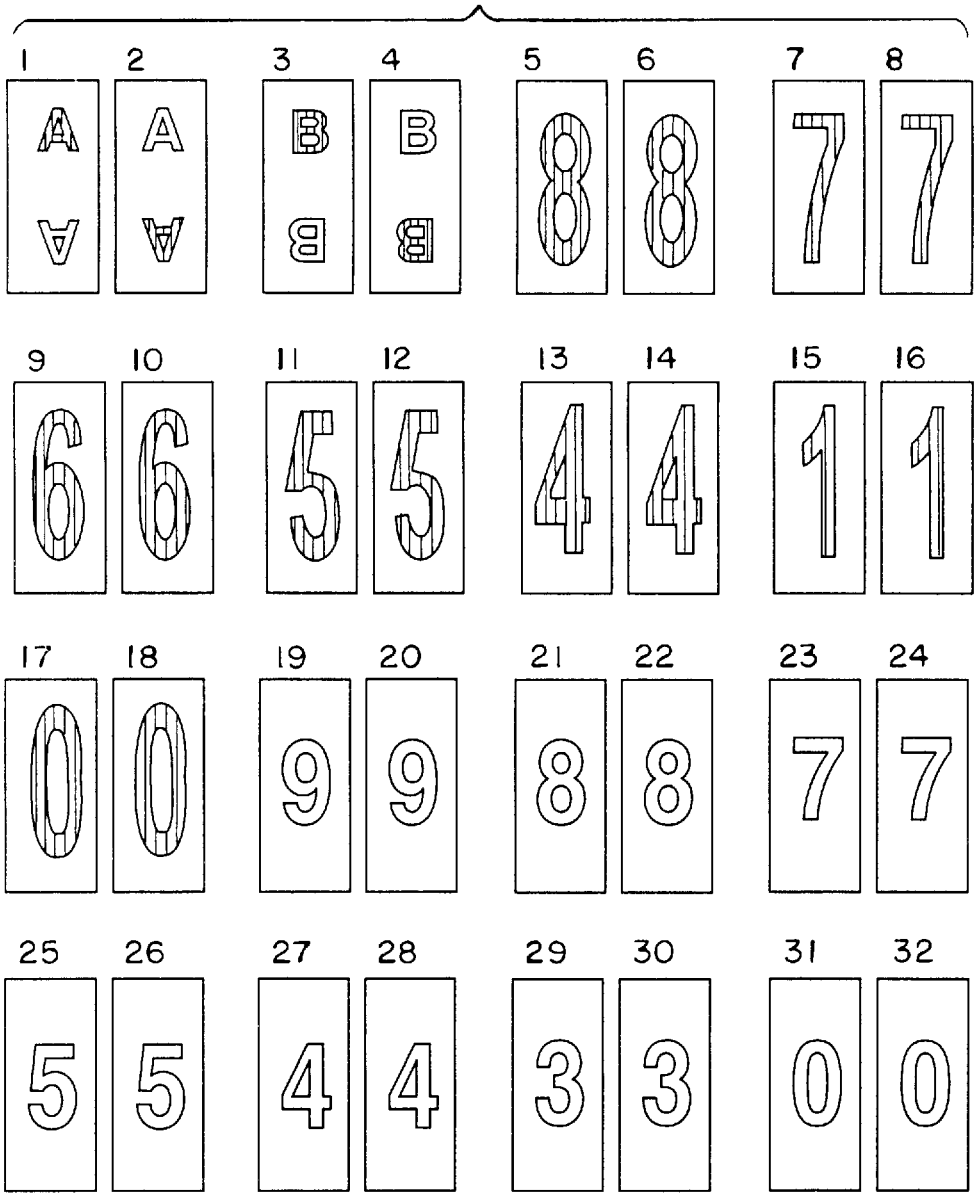
FIG. 1 is a plan view of the preferred embodiment of the game pieces used in GAME 1 of the present invention.
Figure 5:
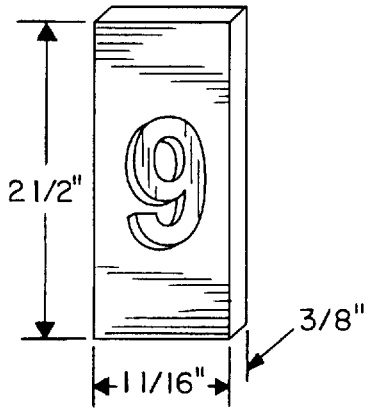
FIG. 5 is a perspective view of the preferred embodiment of the game pieces of the present invention for both GAME 1 and GAME 2.

Referring now to the drawings, there is illustrated in FIG. 1 a view of the preferred embodiment of the game pieces used in the present invention. There are thirty-two game pieces (dominoes, tiles, or cards). Preferably, the game pieces take the form of solid tiles approximately 2½ inches long by 1¹⁄₁₆ inch wide and ⅜ inch thick, as illustrated in FIG. 5. The symbols should preferably be engraved into the body of the tiles so that players can determine tile values by touch. The game pieces can also take other forms, such as paper or plastic cards, or have other dimensions.

GAME 1 (FIGS. 1–5)

In the preferred embodiment of GAME 1, the thirty-two game pieces are comprised of two sets of tiles: One set designated by alphabetical letters, namely, the letters A and B. The second set is designated by numbers, namely 8, 7, 6, 5, 4, 3, 1, and 0. Some of the alphanumeric characters are colored in red and some in white. The significance of the character's color will be discussed later.

There are two "A" tiles and two "B" tiles. The "A" tiles represent the high "deuce" and the "B" tile represents the low "deuce". Other symbols may be used to represent the high and low "deuce". Where the letters "A" and "B" are utilized, each alphabetical character tile preferably has the letter designated thereon twice. The two images are preferably arranged in opposing orientation so that persons in different positions with respect to the tile may easily read the alphabetic character. One of the alphabetic characters on a tile is red in color and the other character is white in color. The significance of the color designations will be described later. The alphanumeric characters 1–18 shown on the tiles in FIG. 1 are lined in order to designate which characters are preferably red.

In this preferred embodiment of GAME 1, there are twenty-eight numeric tiles and the following table summarizes their specific values and colors which have been illustrated in FIG. 1:

| Numeric Value | Color | Number of Tiles |
|---|---|---|
| 9 | white | 2 |
| 8 | red | 2 |
| 8 | white | 2 |
| 7 | red | 2 |
| 7 | white | 2 |
| 6 | red | 2 |
| 5 | red | 2 |
| 5 | white | 2 |
| 4 | red | 2 |
| 4 | white | 2 |
| 3 | white | 2 |
| 1 | red | 2 |
| 0 | red | 2 |
| 0 | white | 2 |

The numerical tiles that are colored "red" are considered dominant over a white tile of that same numerical value. Therefore, the red "8" is considered to be of a higher rank than the white "8".

The alphabetical tiles "A" and "B" have one red and one white character and are considered color neutral.

It is to be noted that there is no white counterpart to the red "1", and there is no red counterpart to the white "3", and the "9" comes only in white and the "6" only in red.

The game is played on a table similar to a Blackjack table and has a layout that has eight positions designated by eight "waging" circles. A House Supervisor, also known as a "House Dealer" supervises the playing of the game. The House Supervisor stands with respect to the players in an approximate position as a dealer would take with respect to players in the game of Blackjack.

In any given game, one of the players assumes the position of "Dealer". For that particular hand, that player is referred as the "Dealer" and the other players will be referred as "players". The Dealer is to be distinguished from the House Supervisor or House Dealer. Every player at the table at one time or another is given the opportunity to be a Dealer for a particular game. However a player can decline the opportunity of being a dealer and pass the opportunity to another player.

At the start of any game, the thirty-two tiles are placed face-down on a playing surface and are inter-mixed and shuffled by the House Supervisor until they are sufficiently random. They are then placed by the House Supervisor in stacks of four, eight tiles wide. Some manner of determining which player or the dealer receives the first stack of tiles must be utilized. It is suggested that a set of three die be rolled by the Dealer in a dice cup. The quantities of the three die are added together. Should the total of the three die be "7", the count starts with the Dealer as "1" and continues clockwise around the playing table. A marker is placed in front of the player that is the seventh player from the dealer. This player is designated the "action button" and receives the first set of four tiles. The player to his left (or the Dealer, if the Dealer is to the action button's immediate left) receives the next stack of four tiles, and this continues until the tiles are passed out.

The object of the game is to arrange four tiles into two hands of two tiles each. Preferably, the higher two-tile hand or combination is consistently placed in a given position with respect to the lower two-tile combination, so that players and Dealer have a reference point as to which two high hands are to be compared and which two low hands are to be compared. For example, the hand consisting of the higher hand may be placed with the two tiles side by side in a vertical position with respect to the player holding the hand. The hand consisting of the lower hand may be placed directly above the higher hand with the two tiles side by side in a horizontal position with respect to the player.

The play takes place between the Dealer and each player. Players do not play against one another. In any game there is one dealer and one or more players. The player's higher two-tile hand is compared to the dealer's higher two-tile hand and the player's lower two-tile hand is compared to the Dealer's lower two-tile hand. In order to win, the Dealer or the player must win both hands. If the Dealer wins one hand or the player wins one hand, the game between the Dealer and that particular player is considered a tie, or a push. Should the Dealer and the player have the identical hand, banker wins the comparison between the corresponding hands. In this way, if the Dealer wins outright one of the two hand comparisons and the other hand comparison is comprised of a Dealer's hand identical to the player's hand, the Dealer wins.

Figure 2:
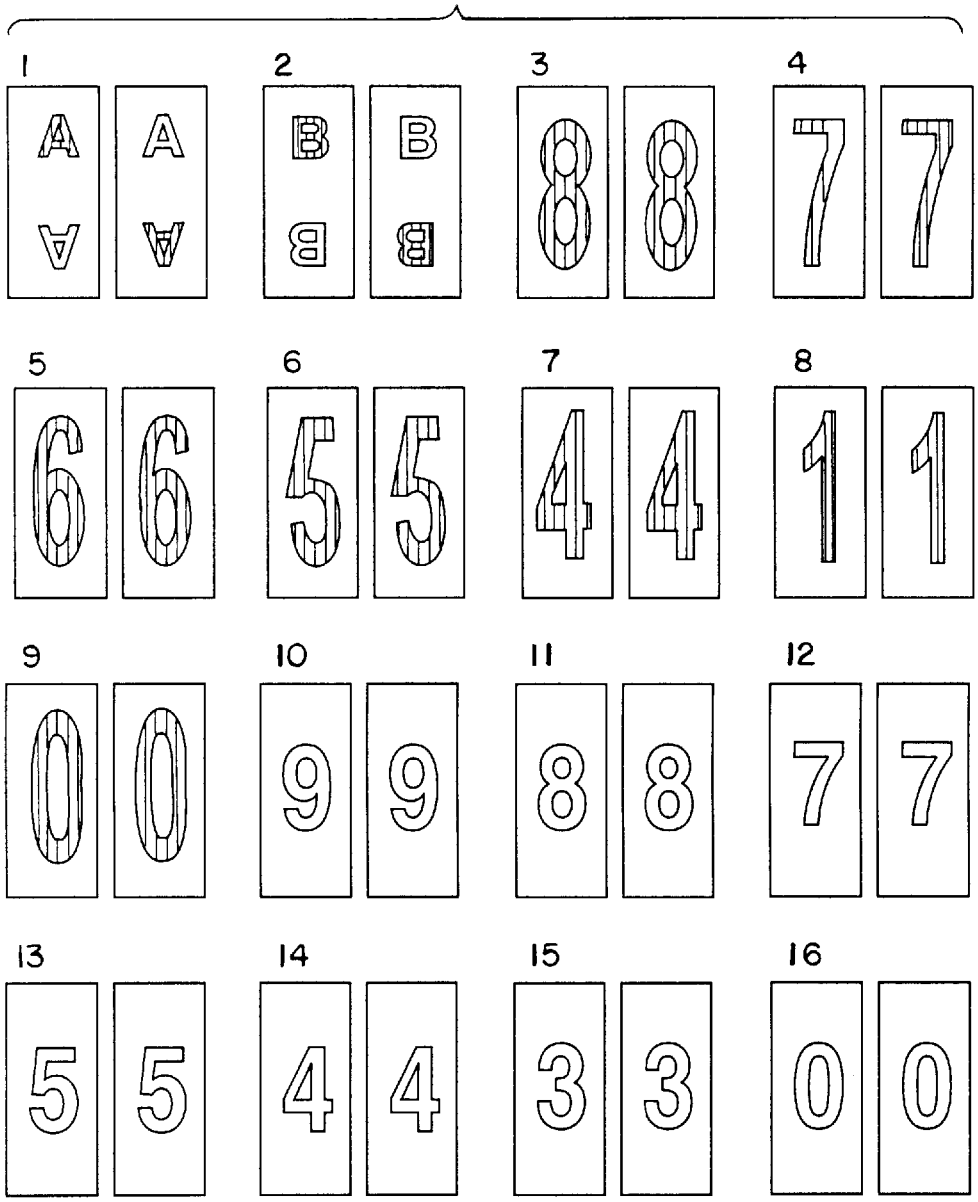
FIG. 2 is a view of the highest ranking hands in GAME 1 of the present invention, showing in order the highest ranking identical pair to the lowest ranking identical pair.

FIG. 2 shows the first sixteen ranking combinations, which all happen to be identical pairs. The highest ranking hand is the pair of "A" tiles. This is the highest possible hand achievable in this game. The second highest hand is the pair of "B" tiles. The third highest hand is the pair of red 8 tiles. The next highest hand is a pair of red 7 tiles, which is higher than a pair of red 6 tiles, which in turn is higher than the pair of red 5 tiles. This continues until the ninth highest pair which is the pair of red "0" tiles. It should be noted that in ranking identical pairs, even the lowest red tile, the red 0, is of higher rank than the highest white tile, the white 9). To indicate the dominance of the red tiles over the white tiles, the red numerals are depicted larger than the white numerals.

After the pair of red "0" tiles, the next highest ranking pair is the white "9" tiles. The progression continues until the sixteenth highest hand, the pair of white "0" tiles.

FIGS. 3A to 3E illustrate the remaining combinations in order of rank. After the sixteenth highest hand, the pair of white "0" tiles, the next highest ranking hand is the A/white 9 combination (denoted by A-w9), which is followed by the B/white 9 combination (or B-w9). The next highest hands are the A/red 8 (A-r8) combination and the A/white 8 combination (A-w8), which are of the same rank. These are followed by the B/red 8 combination (B-r8) and the B/white 8 combination (B-w8), which are the same rank. It should be noted that in the pair rankings, the red numbers are predominant over all of the white numbers, for example the red 0 is higher ranked than the white 9. However in the mixed combinations, when combined with a tile with a value of either "9" or "8", the alphabetical tile is the controlling tile. For example, an A tile in combination with a white 9, is higher in rank than the A tile combined with a red 8. Similarly, an A tile in combination with a white 9 is also higher in rank than the B tile when combined either with the red 8 or white 8. In other words, when an A or B tile is combined with either a 9 or 8, whether red or white, special rules apply and the combination is ranked in the following order: A-9, B-9, A-8 (whether the 8 tile is red or white) and B-8 (whether the 8 tile is red or white). It should be noted that the A-r8 combination is of the same rank as the A-w8 combination.

When pairs, A-9, B-9, A-8 or B-8 combinations cannot be made, the combinations are ranked from nine to zero in the following manner: The quantities on the two tiles are added together. If the total is over ten, the tens digit is discarded.

For example, a "4" and a "7" adds up to 11. The tens digit is discarded and the result is a "1", a very low hand. After the tens digit, if any, is discarded from the hand, the magnitude of the result (otherwise referred to as the "resulting magnitude") is compared with the magnitude of the result of the corresponding hand of the opposing player or dealer; the higher resulting magnitude wins the comparison. For example, a r1-w7 combination hand defeats a r7-w9 combination hand because after dropping the tens digit from the latter hand, the former's resulting magnitude of "8" prevails over the latter's resulting magnitude of "6".

Figure 4:
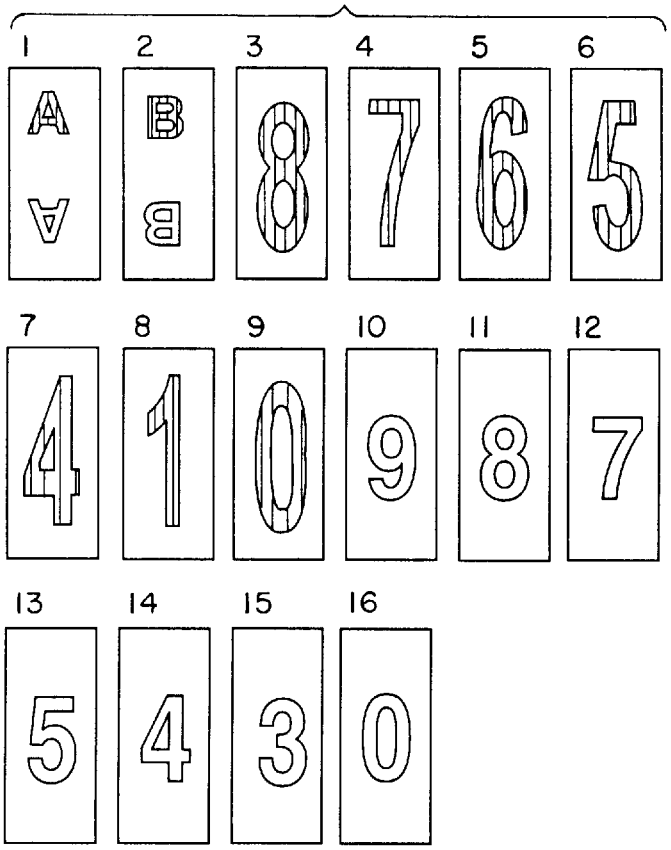
FIG. 4 is a view of the ranking of single value game pieces of GAME 1, showing in order the highest ranking singles indicia to the lowest ranking singles indicia.

When both the dealer's and the player's corresponding hands have the same resulting magnitude, generally, the hand containing the higher singles value tile wins (see FIG. 4). For example, a hand comprised of r8-r1 wins over one comprised of r6-w3 because the r8 in the first hand is of higher rank than the r6 of the r6-w3 hand. However this is not true for hands having a resulting magnitude of "0". All hands having a resulting magnitude of "0" are of the same ranking.

For purposes of non-pairs, or where the hand is not either of the A-9, B-9, A-8 or B-8 combinations, the "A" tile and the "B" tiles are considered "deuces" that have a numerical value of "2". Therefore, an "A" tile and a "6" tile is equal to a hand of "8". The "A" tile is considered the "big deuce" and the "B" tile is the "small deuce". The A-6 combination would be considered higher than the B-6 combination because while both equal 8, the A6 combination contains the big deuce. Similarly, the B-6 combination would prevail over the 8-0 combination because while both total 8, the B-6 combination contains the small deuce, which ranks over the "8", the high card in the 8-0 combination.

When the Dealer and a player have the same ranking combination, this is called a "copy hand". Copy hands are won by the Dealer. For example, if both the Dealer's lower hand and the player's lower hand is w9-w4, and the Dealer's higher hand is r7-w7 while the player's higher hand is w8-r6, the Dealer wins because the Dealer wins the copy hand, and his r7-w7 results in a 14 (or 4) that beats the player's 14 (or 4) because of the higher ranking r7 tile. Since the Dealer wins both hands, notwithstanding the fact that he won his lower hand on a copy hand, he beats the player.

Figure 3A:
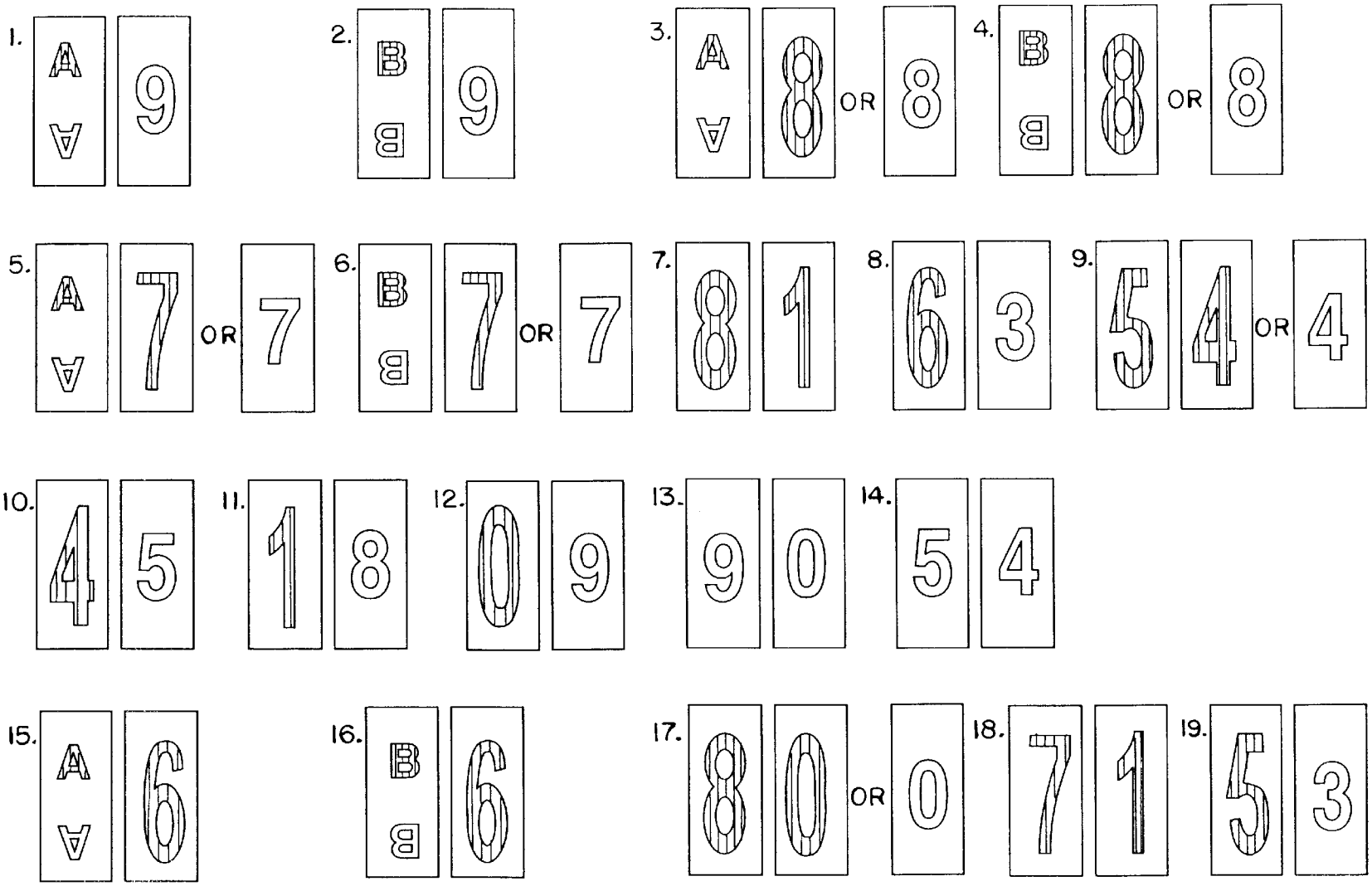
FIGS. 3A to 3E sets out the ranking of mixed hands in GAME 1 of the present invention, showing in order the highest ranking mixed hand to lower ranking mixed hands.
Figure 3B:
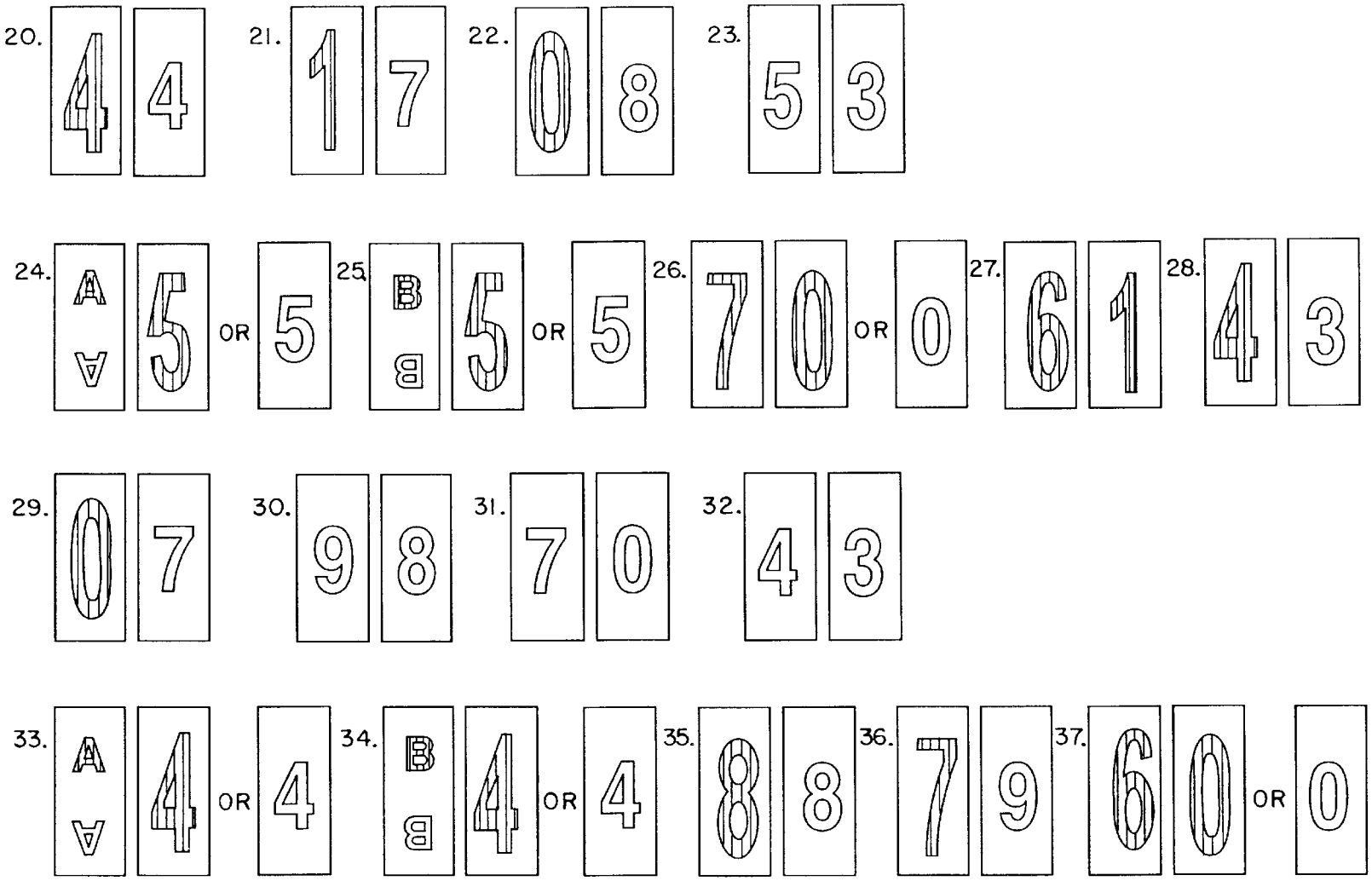
Figure 3C:
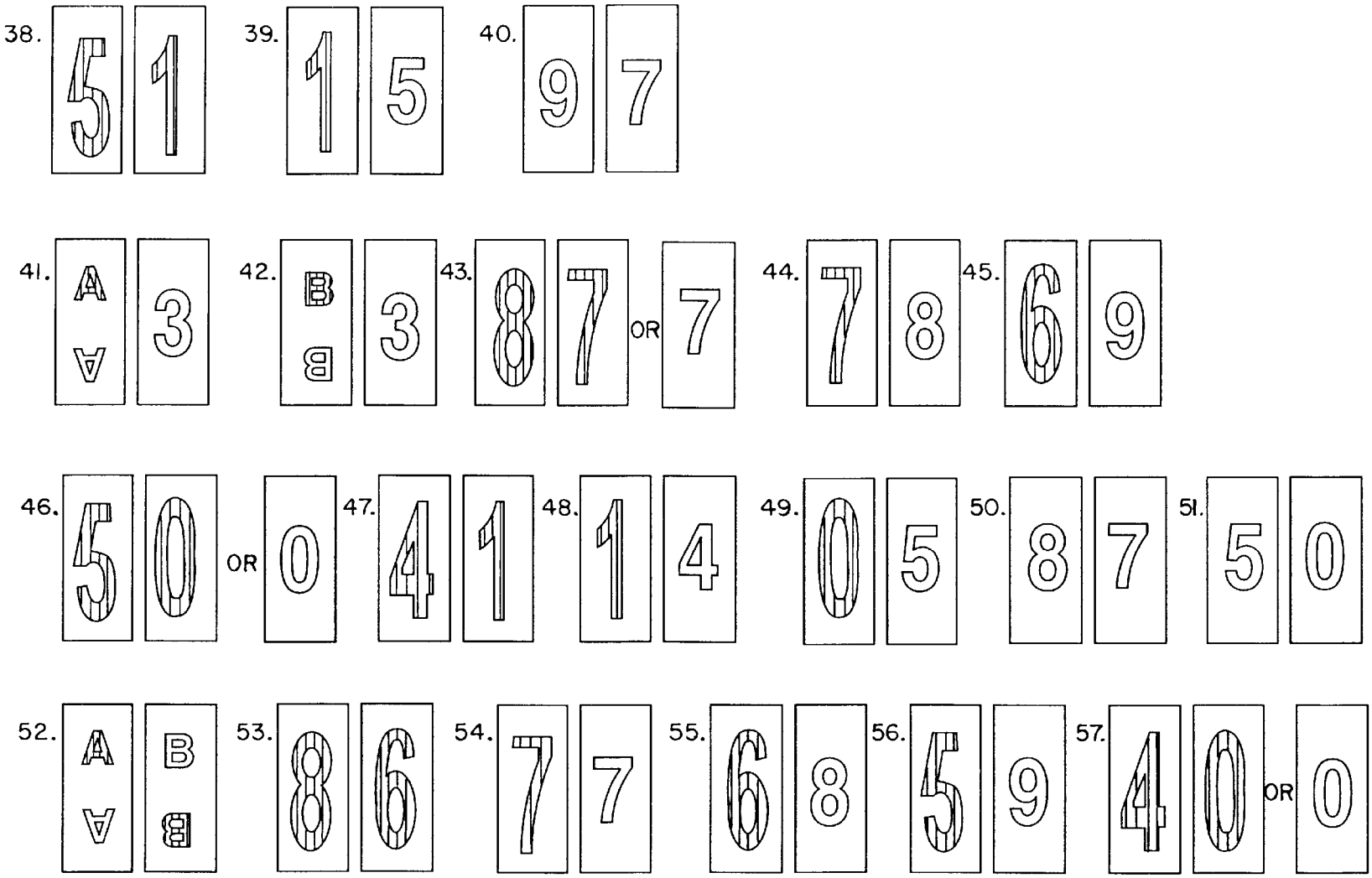
Figure 3D:
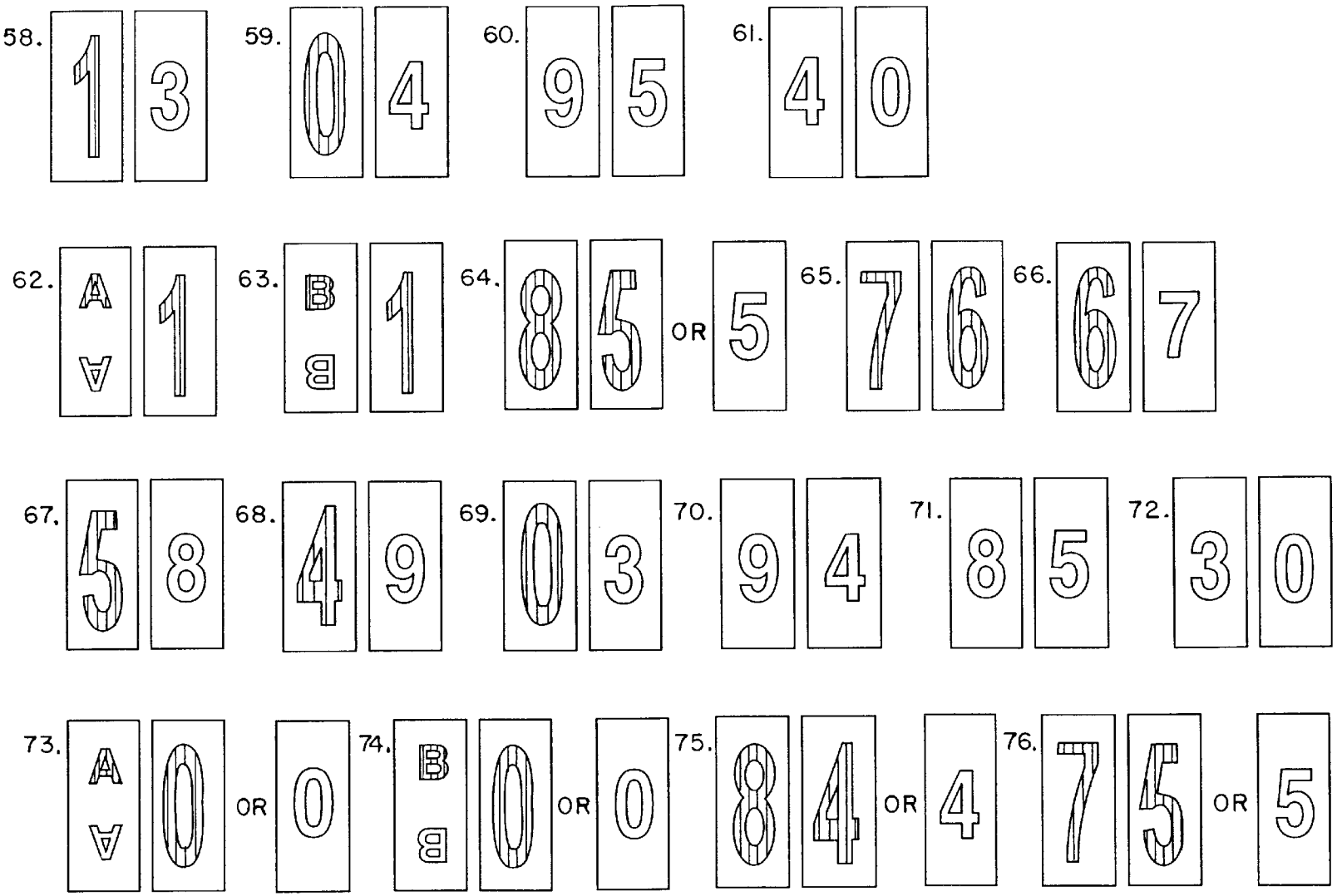
Figure 3E:
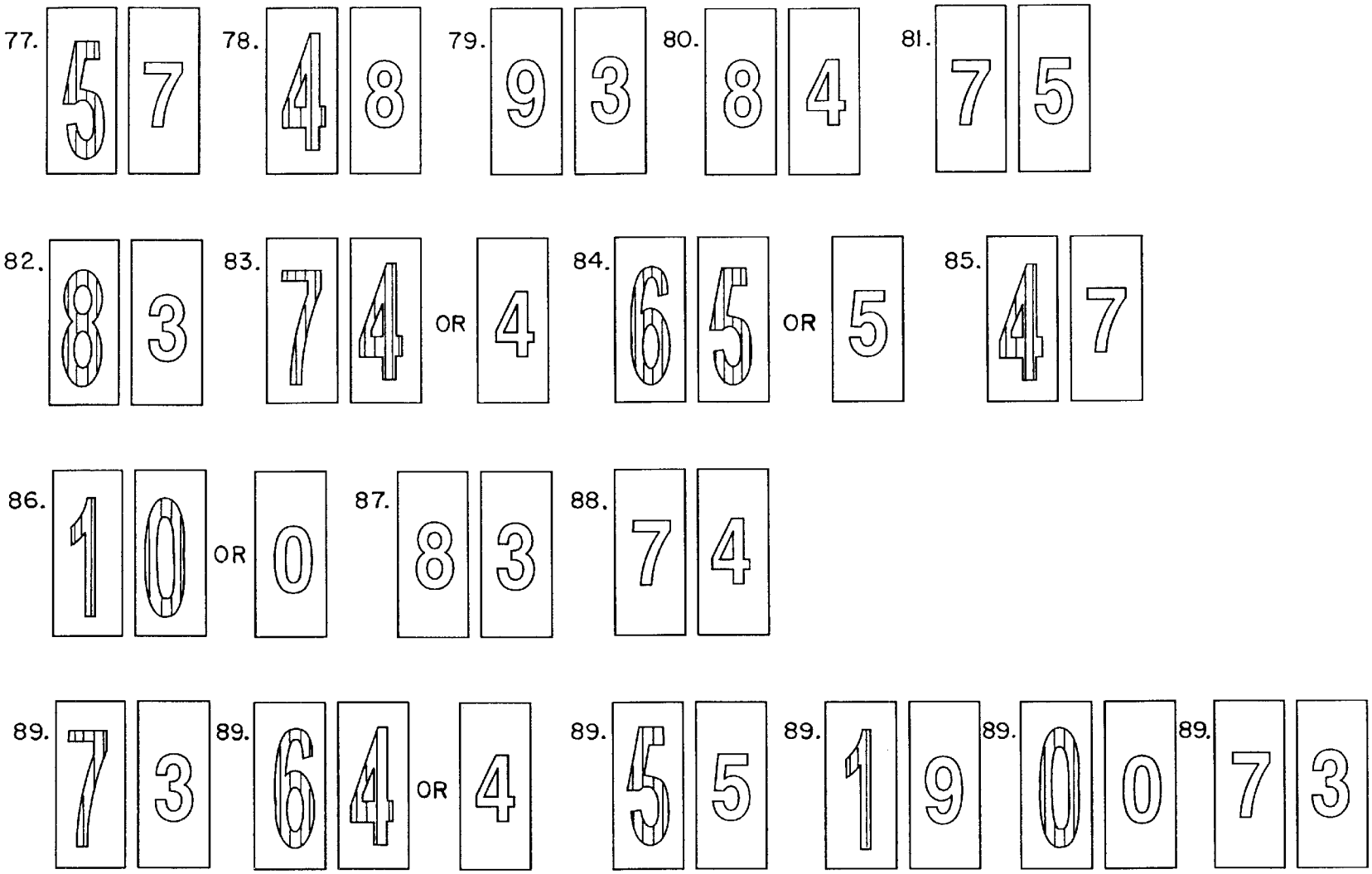

In another example concerning a copy hand, it is noted that all combinations totaling 10, except for A8 and B8, are of the same rank (See FIG. 3E). Thus if the Dealer has a high hand of A-w9 and the player has a high hand of B-w9, and the Dealer has a low hand of r5-w5 compared to the player's w4-r6, this encounter is won by the Dealer since he has a stronger high hand and he wins the lower copy hand.

FIG. 4 is a view of the ranking of singles value game pieces, listing in order the highest ranking singles indicia to the lowest ranking singles indicia.

FIG. 5 illustrates a preferred embodiment of the game piece. The game piece can be any color although the color black is preferred. The alphanumeric characters can also come in a variety of colors. The colors red and white are preferred for the dominant and less dominant pieces, respectively. Ideally, the alphanumeric characters are engraved into the game piece so that players can ascertain the identity of the game piece by touch. The game pieces can be made from a variety of material including plastic, wood, synthetic ivory, or paper.

Variations can also be added to this game to make the play more interesting. For example, in an optional version of the game, the "9", value game piece can be played as a "9" or a "6" and similarly the "6" value game piece can be played as a "9" or "6", depending on the need or desire of the player.

In another version of this game, a "Joker" can be added to the playing deck. The "Joker" could replace one of the white "0" tiles. In this version, the "Joker" is not a true "wild card", because it cannot be made to have any value. Instead, its use is limited to values that would not result in a pair when combined with another card. For example, where a player receives four tiles consisting of a red "5", a white "5", a red "4", and the "Joker", one of best combinations would be "r5"-"Joker" and "w5"-"r4", resulting in two hands with resulting magnitudes of "9". The "Joker" cannot assume the value of "r5" for the purpose of combining it with the "r5" tile resulting in a pair of red "5"s.

GAME 2 (FIGS. 5–10)

GAME 2, similar to GAME 1, is a number game played on a table similar to Blackjack with variations that create excitement. This game is also played with 32 tiles numbered 1–32 shown in FIG. 6.

As in GAME 1, the object of GAME 2 is to arrange the tiles in two pairs, or hands, to obtain the best ranking combinations. Each Player will receive four tiles in one dealing. Two tiles will form the first hand, and two other tiles will make up the second hand. In the preferred embodiment, the object of the game is to obtain a high hand that ranks higher than the Dealer's high hand, and a low hand that ranks higher than the Dealer's low hand. To win, the Dealer or a Player must prevail in both hand comparisons. Again, this game is played similar to the way Pai-Gow is played.

DEALING

The game is played preferably with eight Players. In regions where it is lawful to do so, for example in Las Vegas, one of the eight Players is the Bank, a participant representing the House. The House will always Bank (deal) the first hand; then each Player has the option of being the Bank or passing the Bank (and deal) on to the next Player. If a Player refuses the Bank, the Bank will transfer to the House. In localities where it is not legal for the House to participate in playing the hands, for example in California, the House simply provides a Dealer, and the number of participating players is increased to eight. In such a case, since the Dealer is not a participant in the winning or losing of hands, the Bank is passed on Player to Player. For the purposes of simplifying the description of the game, it will be presumed for the remainder of this description that the Bank (and deal) will be passed on Player to Player, i.e. Las Vegas style.

RANKING COMBINATIONS

Figure 6:
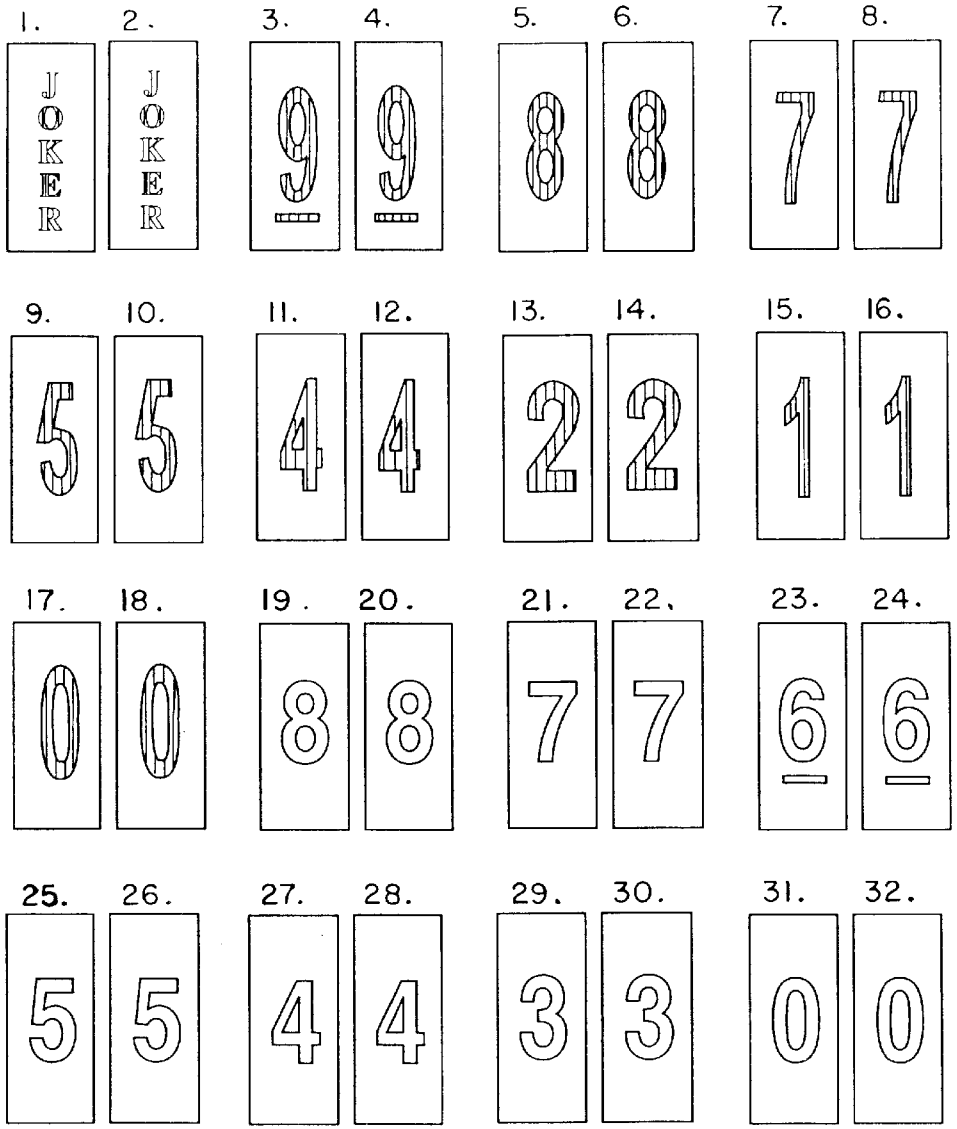
FIG. 6 is a plan view of the preferred embodiment of the game pieces used in GAME 2 of the present invention.

This game, like GAME 1, uses two sets of tiles totaling thirty-two game pieces numbered 1–32 as shown in FIG. 6. However, the tiles display different indicia and are ranked differently than in GAME 1. The first set of tiles contains a pair of "Joker"s, the highest individually ranking tile pair in this game. As an individual ranking tile, however the "Joker" is the lowest ranking. On the other hand, when used as a wild card to combine with another tile for the pair to total 9, the "Joker" can take on any value "0"–"9". The "Joker" will never be used for combining with another tile to form a total value less than 9, since a "Joker" combined with any other numerical tile would automatically take on a numerical value such that, when combined with the other tile would total to 9. Finally, the "Joker" cannot be combined with another tile to form an equivalent identical numerical pair.

The second set of tiles consists of thirty tiles displaying numeric characters.

Figure 7:
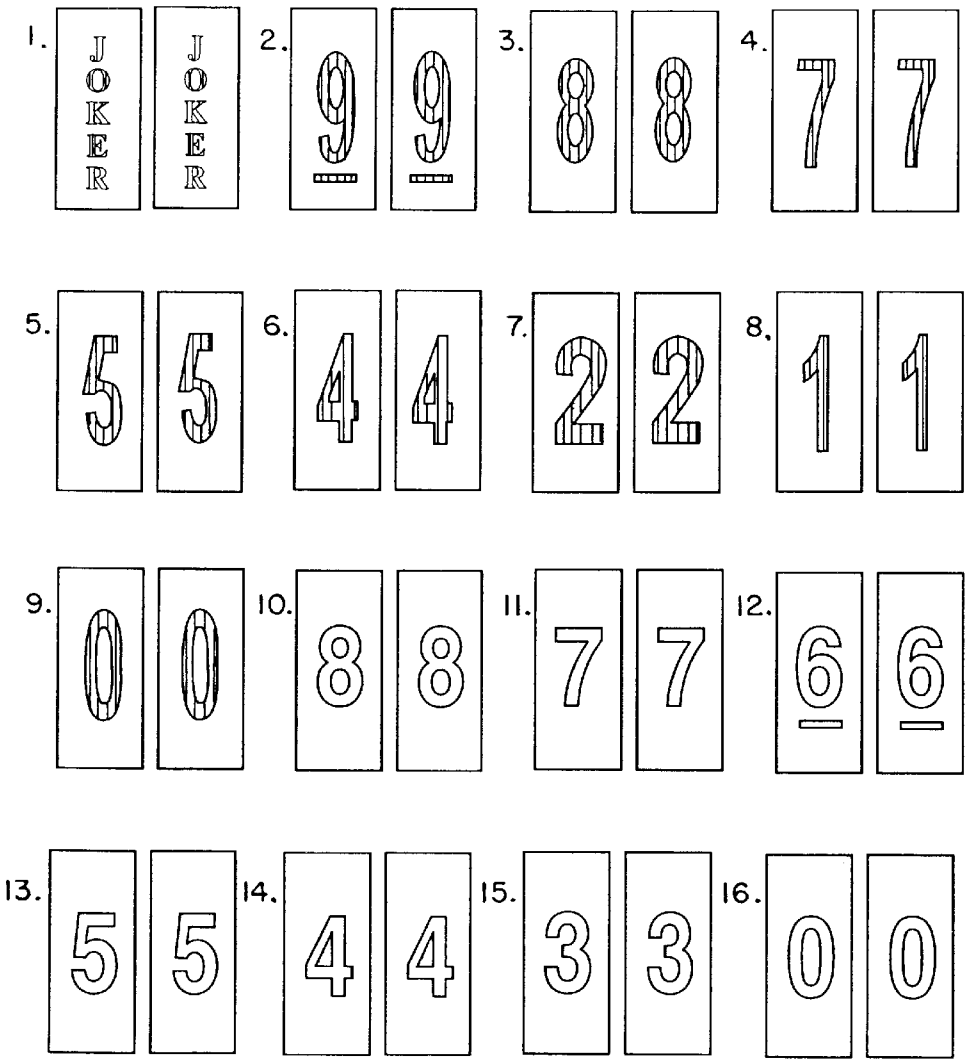
FIG. 7 is a view of the highest ranking hands in GAME 2 of the present invention, showing in order the highest ranking identical pair to the lowest ranking identical pair.
Figure 8A:
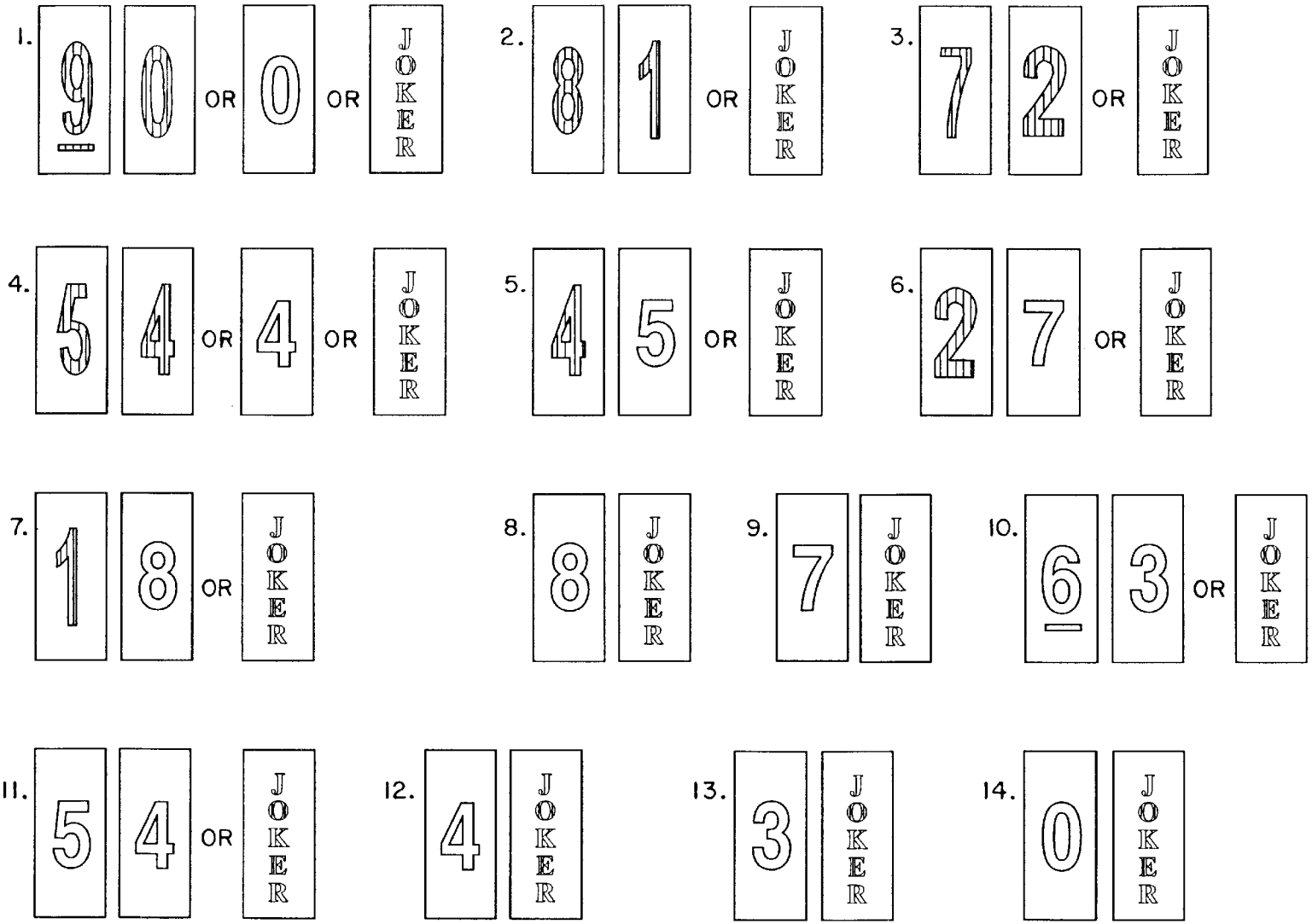
FIGS. 8A–8F sets out the ranking of mixed hands in GAME 2 of the present invention, showing in order the highest ranking mixed hand to lower ranking mixed hands.
Figure 8B:
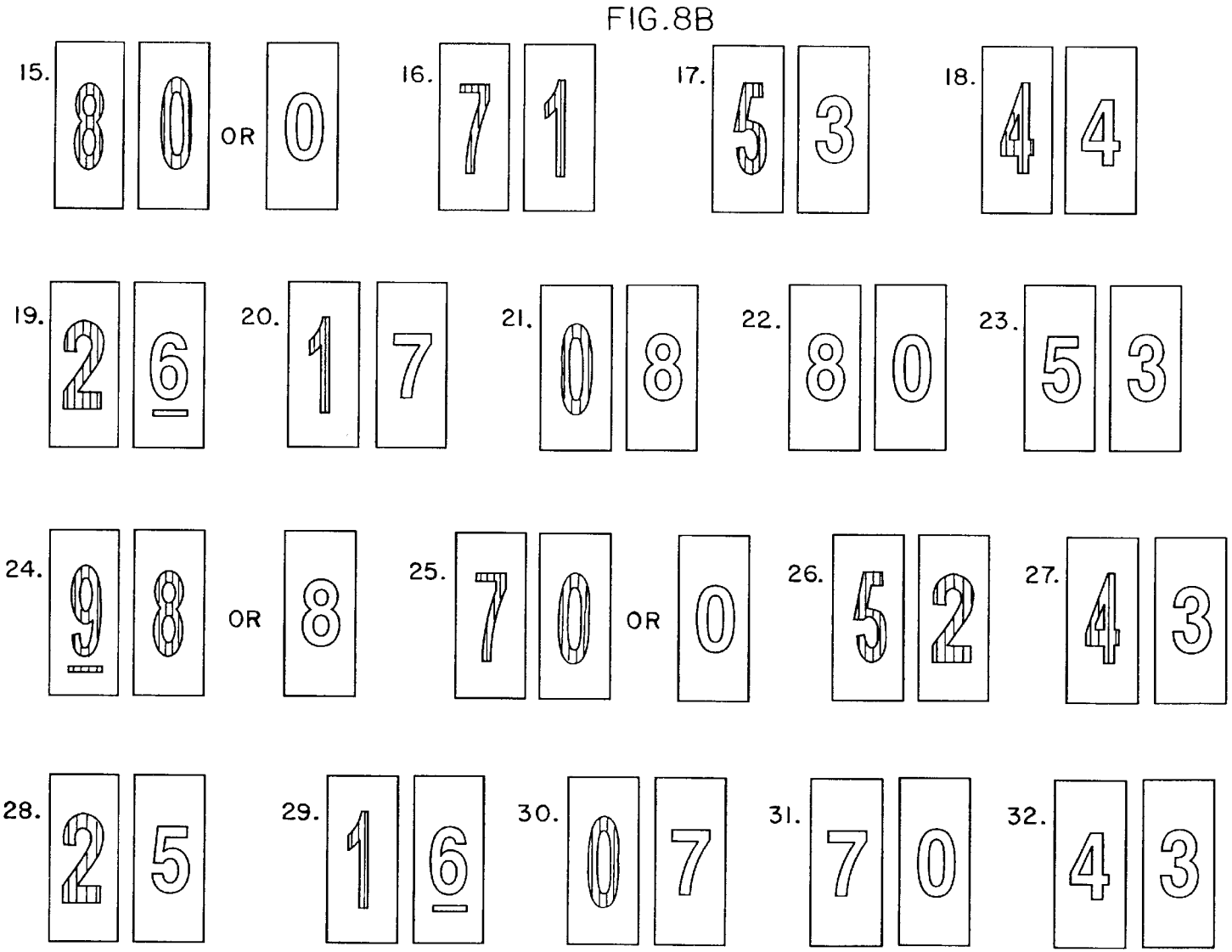
Figure 8C:
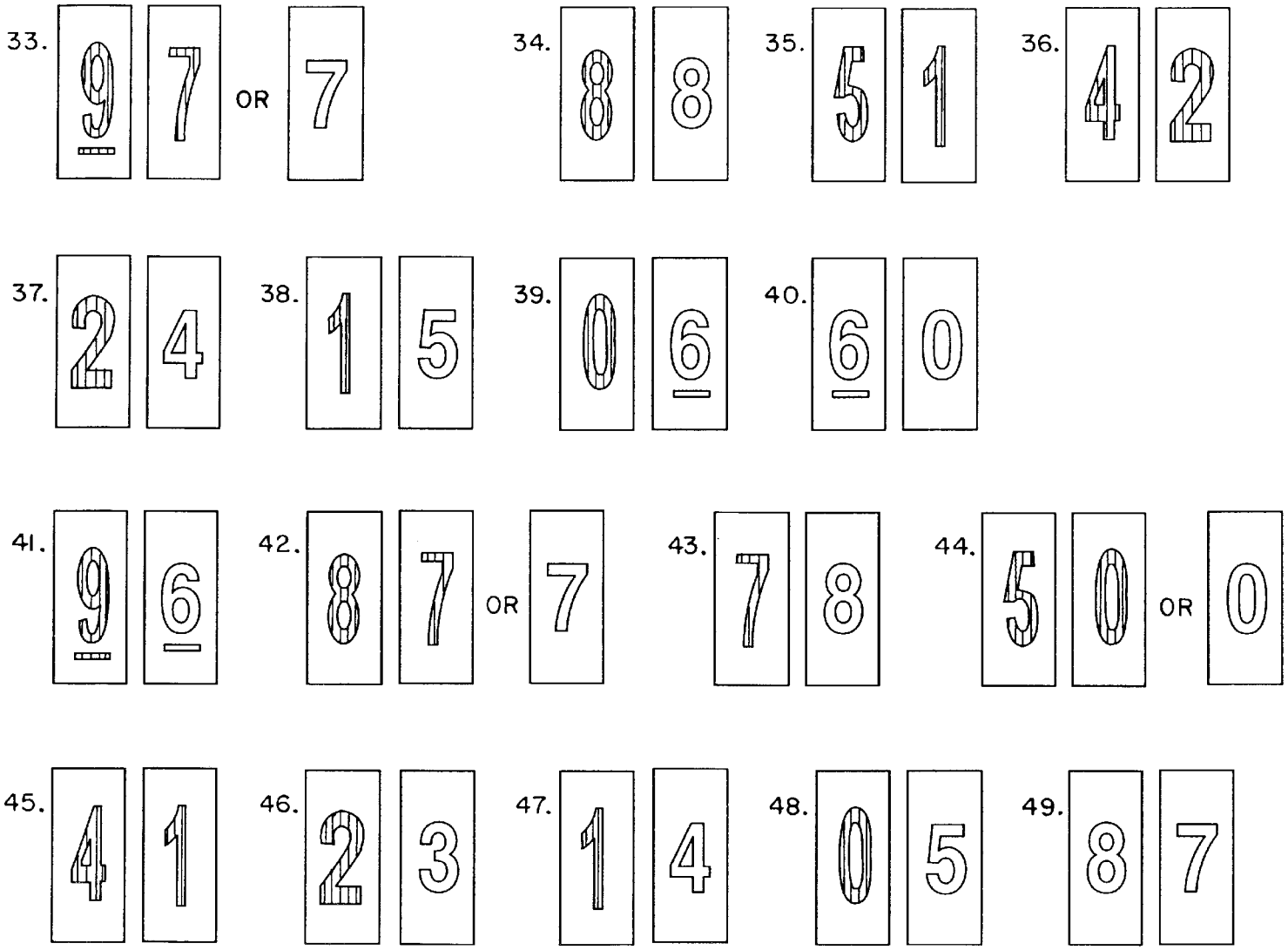
Figure 8D:
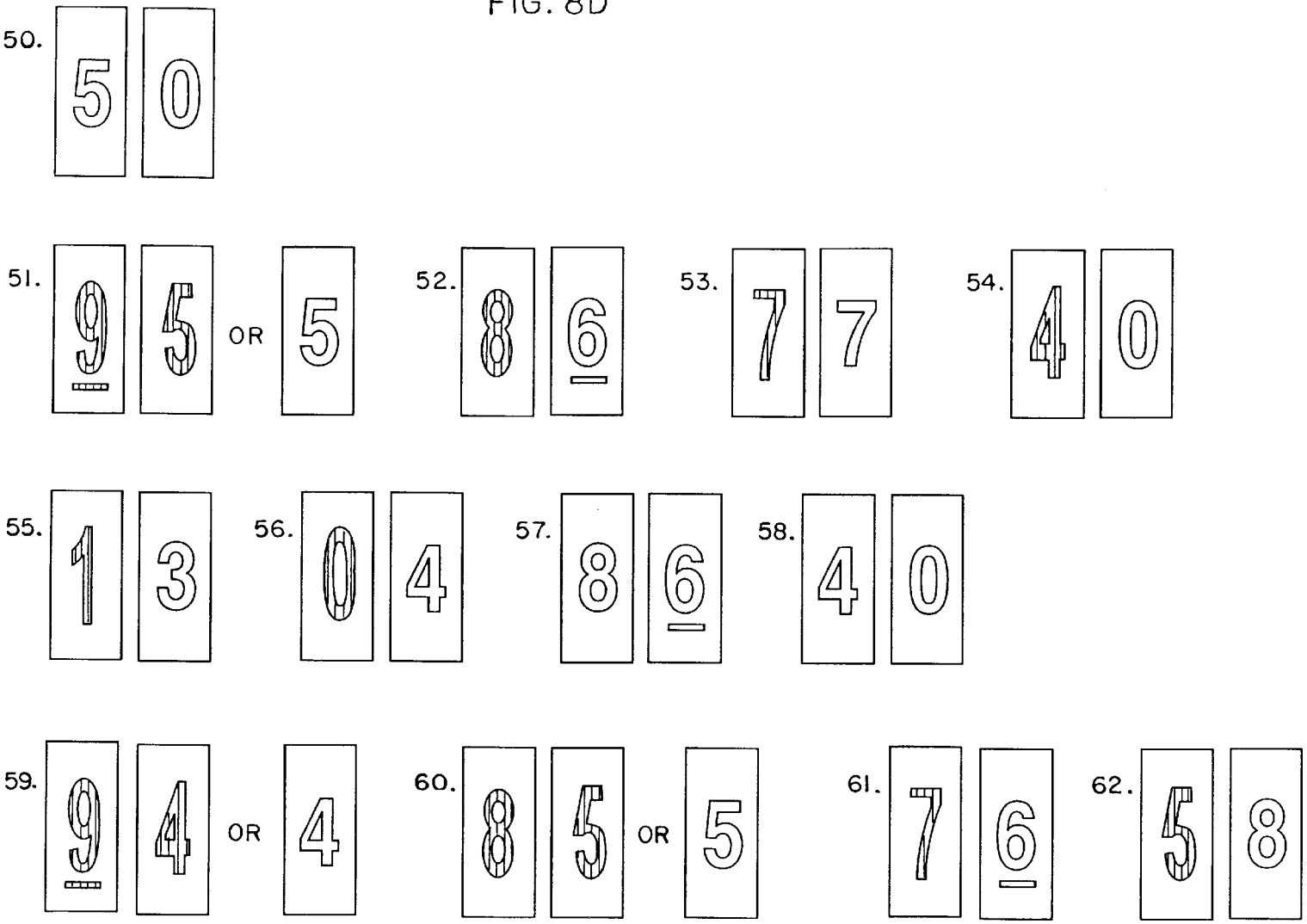
Figure 8E:
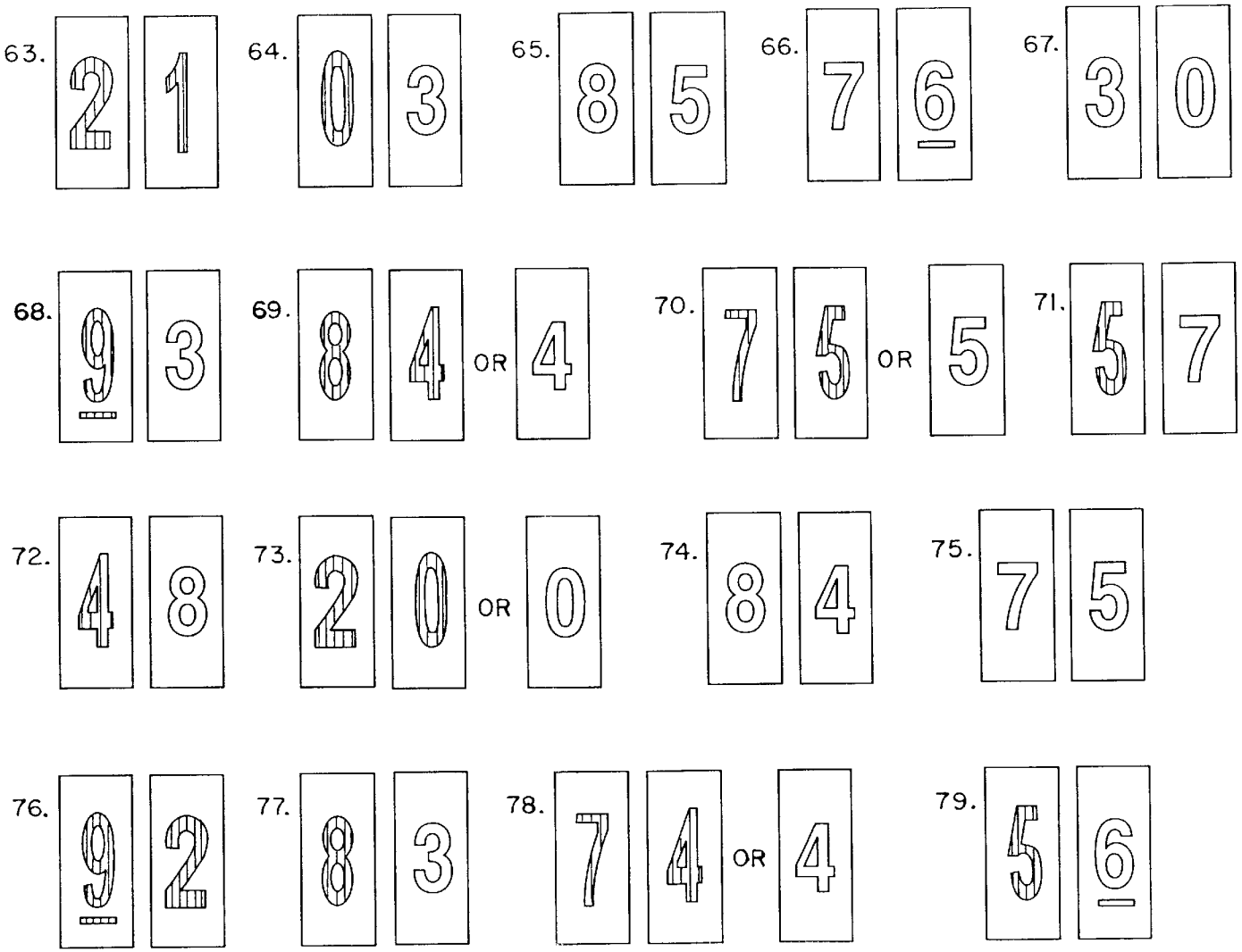
Figure 8F:
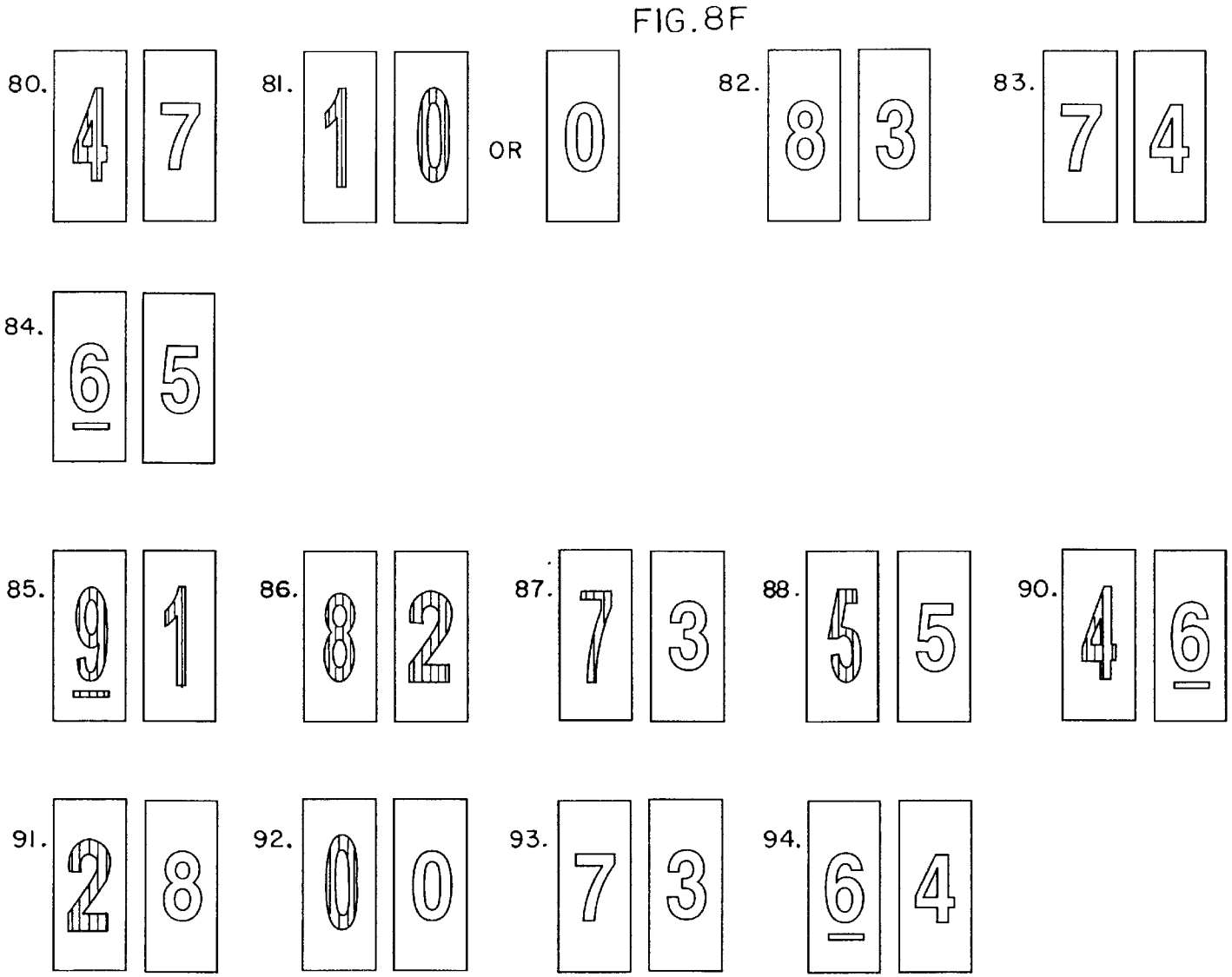

A pair ranking chart is shown in FIG. 7 depicting the highest ranking tile pair 1 to the lowest ranking identical tile pair 16. In pair combinations, the highest hand after the pair of "Joker"s is the pair of identical red "9"s, followed by the pair of identical red "8"s, the pair of identical red "7"s, etc., with the lowest ranking red tile pair being identical red "0"s, followed by the pair of identical white "8"s, the pair of identical white "7"s, etc., with the lowest ranking tile pair being identical white "0"s. An identical pair must have the same numeric value and the same color. For example a red "8"+red "8" is an identical pair, but a red "8"white "8" is not.

After the identical-pair combinations, mixed hands are also logic-based. For example, referring to FIG. 8, the next highest hand, after the pair of identical white "0"s, is a pair of numeric tiles totaling 9, with the red numbered tiles having predominance over the white numbered tiles. Thus, after the pair combinations, the next highest hand is a red "9"+red "0" or a red "9"+white "0" or a red "9"+"Joker". These three red "9"+"0" or "Joker" hands are equal in rank. The next highest ranking combination is a red "8"+red "1" (there is no white "1") or a red "8"+"Joker", then a red "7"+red "2" (there is no white "2") or a red "7"+"Joker", then a red "5"+red "4" or a red "5"+white "4" or a red "5"+"Joker" etc. Other combination ranking and tie rules apply as will be discussed in detail hereinafter.

In other words, the ranking system is, in large part, based on a rational sequential progression simpler than that described in connection with GAME 1.

As indicated, in playing GAME 2, the dealing of the tiles, the number of tiles dealt, the House rules, and the general rules for winning hands is similar to that of GAME 1 described above.

It is very easy to memorize the ranking in GAME 2. It is only necessary to memorize, or refer to, the chart of FIG. 7 for the first sixteen rankings (pair rankings), the chart of FIG. 8 for the next fourteen rankings wherein tile pairs total 9, and, except that "Joker"s will not be used to make a pair of mixed tiles total less than 9, the same logic of progression of tile pair values is the same as that described above for pairs of tiles totaling 9.

Figure 9:
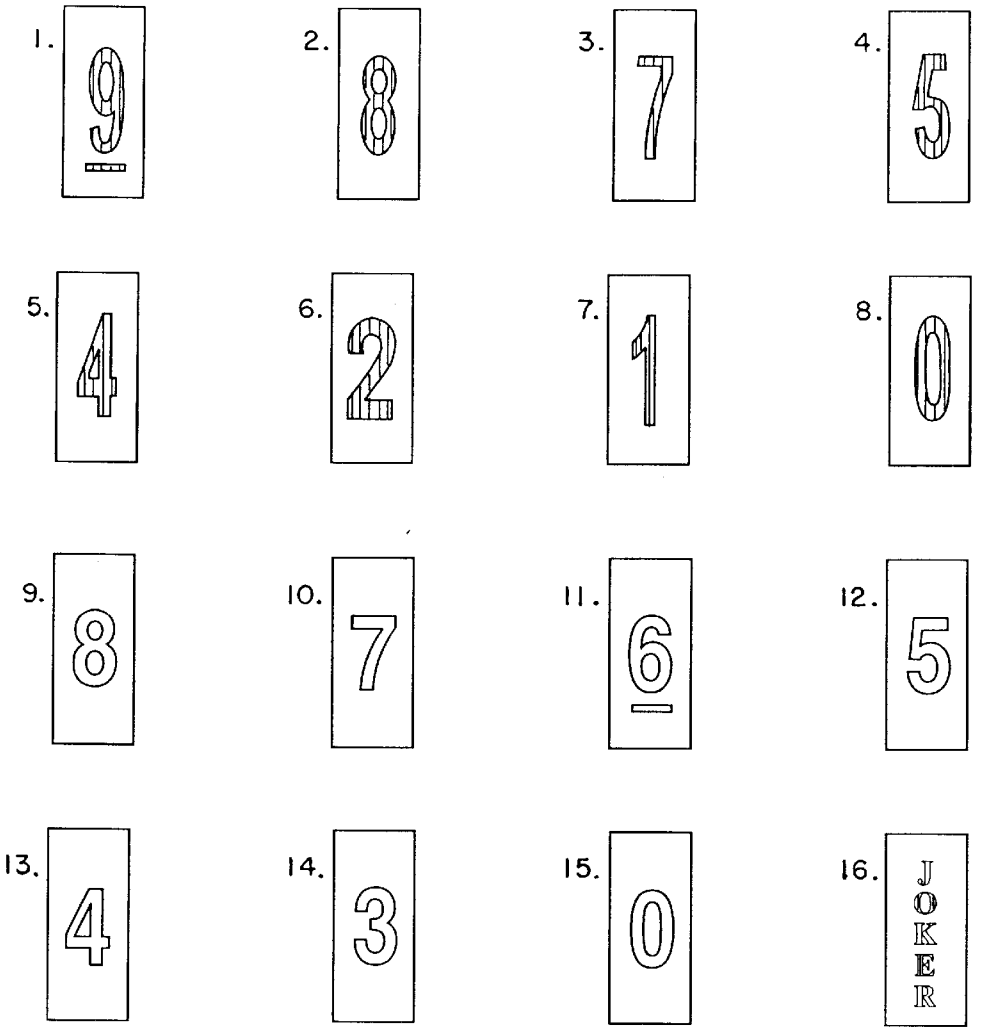
FIG. 9 is a view of the ranking of single value game pieces of GAME 2, showing in order the highest ranking singles indicia to the lowest ranking singles indicia.

Thus, when the two tiles in a hand do not form a pair and cannot add to 9, the hand with the numerical total of the two tiles closest to 9 wins, with red numbers always outranking white numbers. However, in the event of a tie in numerical totals for the Dealer and the Player, the hand with the single highest ranking tile according to the ranking chart of FIG. 9 wins.

For individual tiles, the highest is a red "9", second is a red "8", third is a red "7", next is a red "5", then a red "4", etc. The lowest single ranking tile is the "Joker". Such single, or individual, ranking is depicted in descending order as tiles 1–16 in FIG. 9.

The red predominance over white must always be recognized for all combinations of tile pairs which are either identical number pairs or pairs totaling 1–9. This rule does not apply to tile pairs totaling 0. As with game 1, when combinations of numbers add to a value of 10 or greater, the tens digit is dropped, and the ones digit becomes the total numerical value for that tile pair. With reference to FIG. 8, the 84th tile pair, a white "6"+white "5", when the tens digit is dropped, becomes the value 1. Different rules apply to the remaining lower ranking tile pair combinations which have the value 0, i.e. the tile combinations 85–94 shown in FIG. 8. These latter nine tile pair combinations, all having the value 0, are of equal rank.

The general rule when a Dealer and Player both have the same numerical total or value in the pair of tiles being compared is that the pair with the highest individual ranking tile wins. The exception, as also noted earlier in this description, is when the Dealer's hand and the Player's hand being compared both have the value 0, in which case, the Dealer wins independent of which hand has the highest individual ranking tile. Thus, when a Dealer has, for example pair combination "6"+"4" and the Player holds the pair combination "9"+"1", the Dealer wins despite the fact that the Player has the higher ranking individual tile, because of the rule that a "0" tile pair comparison is always won by the Dealer.

Figure 10:
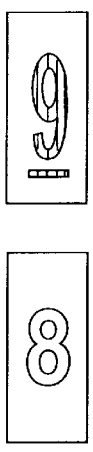
FIG. 10 illustrates the relative size of indica on the red colored number tiles compared with that of the white colored number tiles.

FIG. 10 shows a pair of tiles, one bearing the numeric value 9, and the other bearing the numeric value 8. Typically, the indicia on the face of each tile is embossed (e.g., impressed, carved, ablated, or molded in), permitting a player to feel the embossed indicia and know of a tile's ranking or value without having to visually view the face of the tile. The "9" tile in FIG. 10 is lined to show that it is red in color, while the "8" tile is representative of a white numbered tile. Importantly, it is to be noted that the red numbers are slightly larger than the white numbers, and this can be observed throughout the drawings of FIGS. 1–10.

This size distinction is important for several reasons. First, it emphasizes the higher ranking of a red-colored tile over the same numbered white-colored tile. Secondly, for those using the "feel " method of determining the value of each tile, an experienced Player can tell the difference between the red and white numbered tiles by feel sensing the size of the numbers on the face of the tile. Also, for people who are color blind, the difference in contrast between a red and white tile, under certain lighting condition, could cause confusion. The size difference immediately conveys to the color blind person the ranking significance of a tile.

As suggested, experienced Players, not wanting to take the risk of exposing their hands, will keep the tiles face down at all times. The Player will use his or her fingers to run over the bottom of the tile and feel the surface projections or depressions which are used to create the indicia and numerical designations for the tile. While this can be done with indicia and numerical designations as shown in FIGS. 1–10, an alternative design for the faces of the tiles can result in an easier-to-read tile using the "feel" method.

For example, the tile face designs shown in FIGS. 11 will permit the tiles to be used by both those who wish to know the value or ranking of a tile by viewing it and those who wish to use the "feel" method. As will be observed, the "0" tile displays an oval-shaped "0" at its center (alternately, it may be totally blank) so that a visual glance at or a feel of the tile face will immediately convey to the Player that this is a "0" tile. The "1" tile has a single dot at its center embossed into the face of the tile, for example. Again, visually this is obviously the "1" numbered tile, and the Player using the "feel" method will feel a single depression conveying the same information.

Figure 11A:
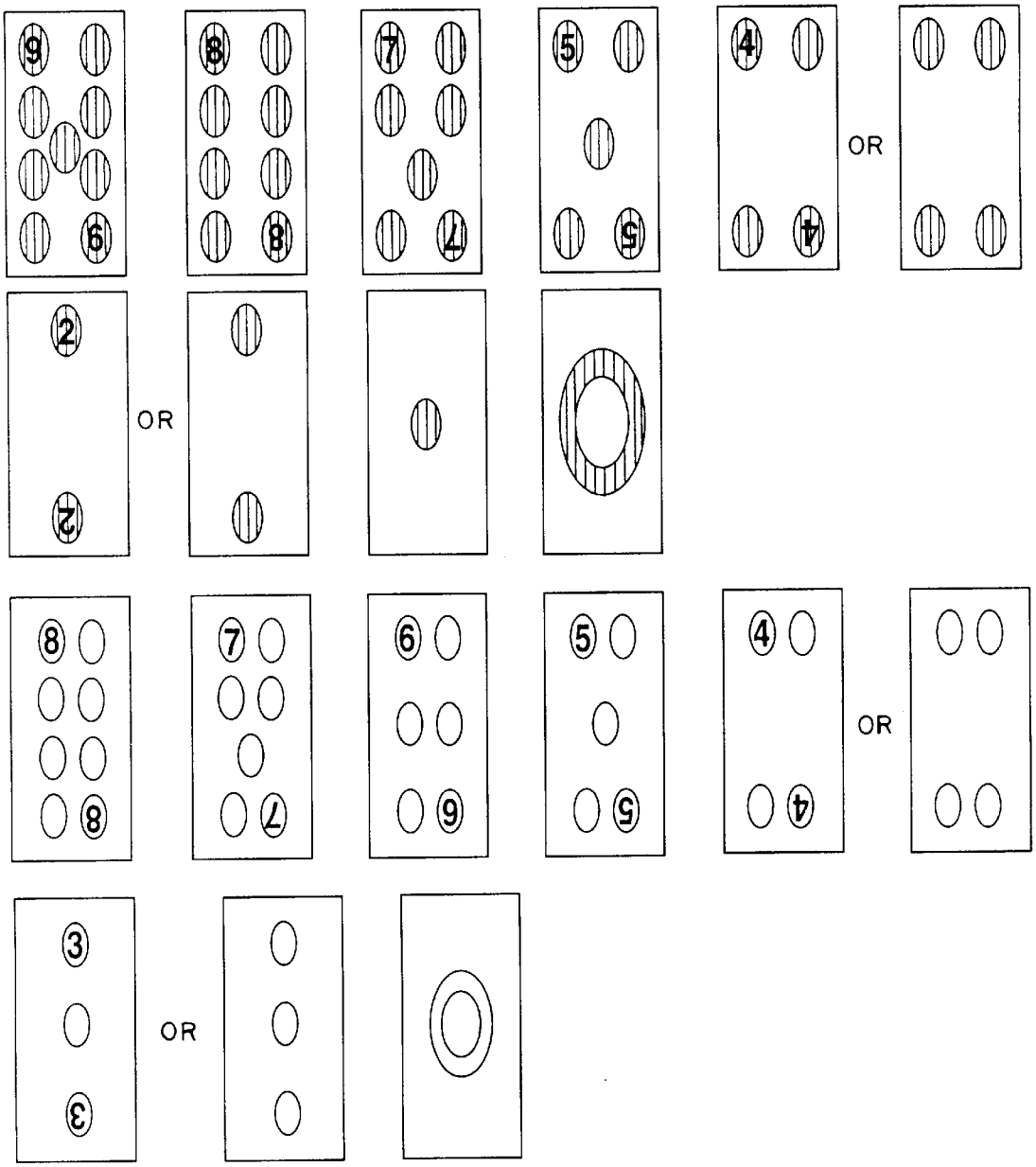
FIG. 11A depicts alternate tile face designs wherein the number of dots (e.g., any of a number of designs such as geometric symbols either embossed into or projecting from the facial surface of the tiles, and/or relatively small numerical projections or depressions representing the numerical values of the tiles also either embossed into or projecting from the facial surface of the tiles)
Figure 11B:
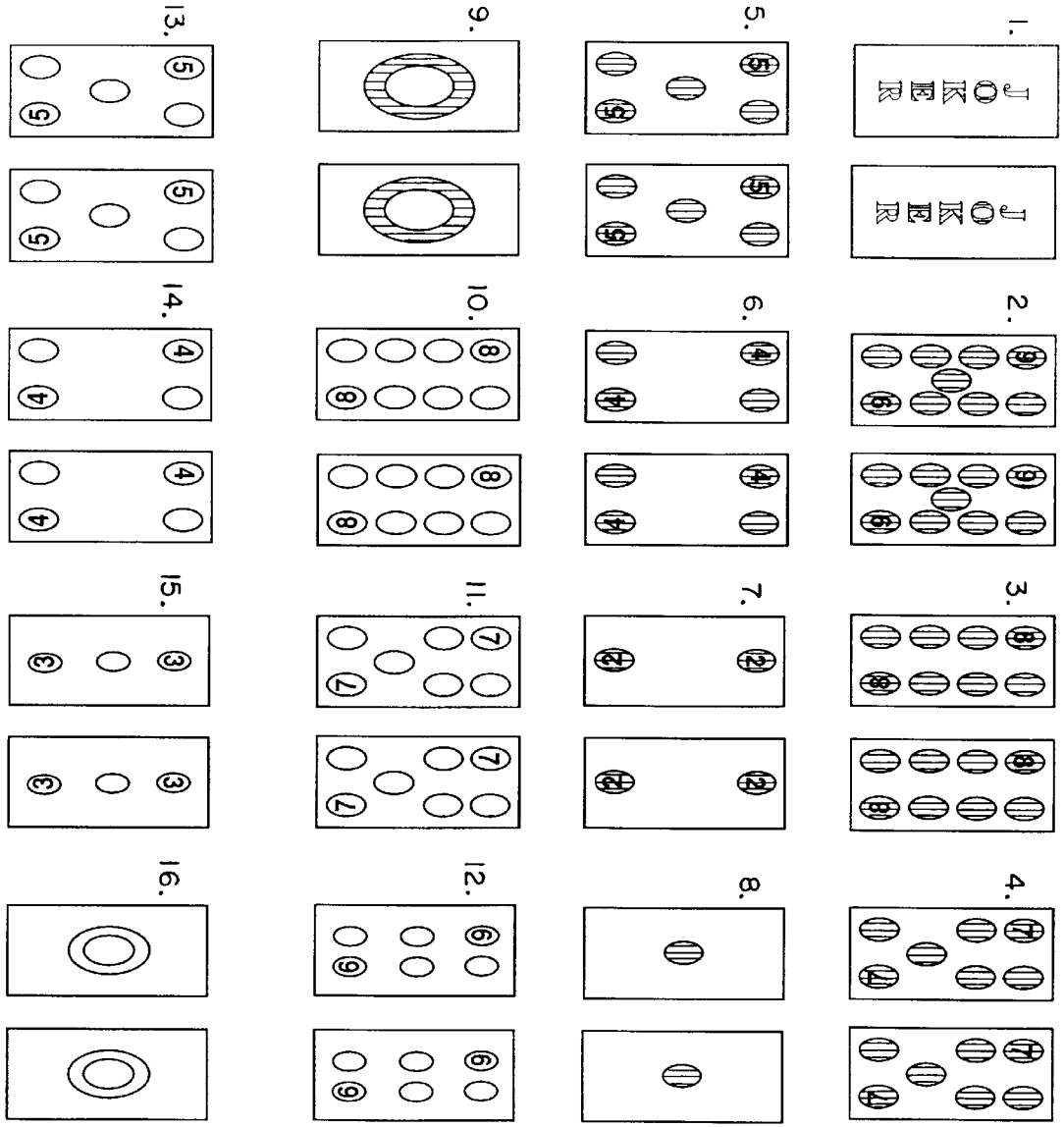
FIG. 11B shows, in order, the highest ranking identical pairs employing a preferred design style taken from the alternate design styles shown in FIG. 11A.

Likewise for all of the other tiles shown in Figures 11A–11C, the number of projections or depressions on the face of each tile being equal to the numerical value of that tile. In order to accommodate those Players who wish to visually see the numerical representation of the value of the tile, one or more of the projections or depressions may be formed in the configuration of the number value for that tile or a dot projection or depression may display a number value within the area of the dot, and the rest of the projections or depressions can be circular dots or any other desired design or configuration. For example, the "7" tile shows the numeral 7 right side up in the upper left-hand corner of the tile face, while another numeral 7 is placed upside down in the lower right-hand corner. Since these two relatively small numerical designations, being projections or depressions themselves or contained within projections or depressions, will be felt by the Player as two separate projections or depressions, the "7" tile also includes five round (circular or oval) projecting (convex) or depressed (concave) dots. The numerical value designation in the lower right-hand corner of the "7" tile is so oriented to permit a Player to visually see the numerical value of that tile independent of its position as shown in FIGS. 11A–11C or in the upside down position from that shown in FIGS. 11A–11C.

When using a set of tiles as shown in Figures 11A–11C, a Player using the "feel" method may more easily determine the numerical value for the tile he or she is holding, but the color of that tile is, of course, not readily apparent by simply counting the number of projections or depressions. To solve this problem, each red tile can have a symbol at a particular location on the tile which can be quickly felt by the Player (or not if absent), indicating whether the tile is red in color or white in color. For example, the "4" tile shown in FIG. 11A has a long (impressed or protruding) bar along one end of the tile. This would designate that this tile is a red tile. The white "4" tile would not have the bar, and thus would be immediately known to the Player using the "feel" method that this tile is a white tile. Obviously, other symbols, indicia, or other physical characteristics of one color tile different form the other color tile can be used instead of the bar illustrated as exemplary only in FIGS. 11A–11C.

The particular arrangement of projections and depressions, and the particular number of dots versus numerical representations is strictly a matter of design choice, and the illustrations in Figures 11A–11C are to be understood as being exemplary only. For example, all projections or depressions may be circular dots or all projections or depressions can be numerical designations. The "1" tile can have either a single dot as illustrated or a projection or depression configured as the numeral 1. The "2" tile can have either a pair of plain dots or two dots with the numeral 2 visible within the confines of the dots. The same alternate configurations (dots without numbers and dots with numbers) may apply to the "3" and "4" tiles, since an observer can quickly identify the tile value without having to mentally count the dots. For tiles having numerical values of "5" or greater, it is recommended that the numbered dot configuration be used.

Since it is a design choice as to whether the different surface discontinuities of the tile shown in FIGS. 11A–11C are projections or depressions, in the event that they are projections (rising from the facial surface of the tile as shown in FIGS. 12 and 13), a ridge R around the tile would be required in order to keep the tiles from rocking when they are placed on a flat surface, such as would be the case at least with the "1", "2", and "3" tiles, and to avoid detection of the projections defining the tile value from the sides or ends of the tile.

As general guidelines for arranging the four tiles in the two hands (high and low hands), the following rules can be followed:

1. Play the tiles arranged in pairs.
2. In the absence of any pairs, play two-tile combinations that total 9 or closest to 9.
3. In the absence of any of the above, play high-value tiles with low-value tiles to provide as high a hand as possible in the lower-value hand. This strategy is used to at least beat the Dealer's low hand and prevent the Dealer from winning, recalling that both hands must each prevail in order to win, and both hands must be lost in order to lose.

More sophisticated players will deviate from this general set of guidelines depending on the level of each Player's skill and experience.

When a Dealer and a Player have the same "Ranking" combinations in a hand, otherwise called a "copy" hand, the Dealer is the winner. If both the Player and the Dealer have the same numerical valued hand, the hand with the single highest ranking tile wins (only the highest ranking tile is considered), except that when one of Dealer's hands totals 0 and a Player's corresponding hand played against the "0" hand of the Dealer also totals 0, the Dealer's hand is the winner.

Example: Dealer has red "5"+white "4"=9; Player has white "5"+white "4"=9. Dealer wins with the red "5" ranking higher than the white "5".

Example: Dealer has red "4"+red "2"; Player has white "6"+white "0". Dealer wins with the highest ranking tile in the Dealer's hand, the red "4", outranking the Player's highest ranking tile, a white "6".

Example: Dealer has red "0"+white "0"=0; Player has red "4"+white "6"=0. Dealer wins the hand.

If the hands were reversed as between the Dealer and the Player, Dealer still wins.

RULES FOR GAME 2:

All action is between the Dealer and each of the other Players. The Players will rank their tiles and set the two combinations side by side in front of their bets. The Dealer will show his hand first, and then turn over the hands of the Players to determine the losers and winners.

Each Player has the opportunity to be the Bank (and Dealer) against other Players. A Player may be a Dealer at any playing position. To be the Bank, however, a Player must have played the previous hand as a non-Bank and must be able to cover all bets. Alternatively, if the Player cannot himself cover all bets, the Player may co-bank 50—50 with the House. If he co-banks with the House, where permitted, the co-Bank Player's tiles must be arranged according to standard House procedures.

Action during a game always proceeds clockwise, starting with the action button. A misdeal will be declared if a "Joker" tile is exposed. If a non-participating Dealer has stacked the game pieces for dealing, the Bank may re-stack the tiles in an arrangement of his or her choice, or ask the Dealer to do so. The Bank may also indicate where the deal is to begin from the stacked set before shaking the dice to determine which Player gets the first set of tiles.

If tiles are dealt out of order and if no action has yet taken place, a misdeal will be declared. However, if action has already begun, the hands will be played as dealt.

A non-participating Dealer may assist and/or advise upon a Player's request, but is not responsible for the final decision. Players are solely and ultimately responsible for the final arrangement of their tiles.

Once the first Player's hand is exposed, the Bank may not reset his or her hand. The Bank's hand will not be exposed until all hands have been set.

During the stacking of the tiles:

a) If the Dealer inadvertently exposed one tile during the deal, the Bank may either ask for a reshuffle or accept the stacks as playable. If the "Joker" tile is exposed, the Dealer must reshuffle the deck.

b) If the Dealer exposes two or more tiles, a misdeal must be declared. All tiles must then be reshuffled and redealt.

After the stacking of tiles but before the deal is complete:

a) While a Bank is distributing tiles to himself or herself, should one tile be exposed to view, the Bank must accept the deal and play the hand that has been dealt; if two or more tiles are exposed to view, it is considered a misdeal, and all tiles must be reshuffled and redealt.

b) While a Dealer is distributing tiles to a Player other than the Bank; should one tile be exposed to view, the Player must accept the deal and play the hand that has been dealt; if two or more tiles are exposed to view, the individual Player's hand is void and his or her bet is returned.

The House Supervisor's decision is final. Once a new hand has begun with shuffling of the tiles, the House Supervisor cannot render a decision regarding a previously played hand.

JOKERS WILD DOMINOES VERSION OF GAME 2

To create more excitement in the playing of GAME 2, a "Joker" tile (domino) is made wild in this version of the game. A "Joker", in a hand that contains a "Joker", assumes any value from "0" to "9" for the sole purpose of making the numerical total for the pair of tiles in which it is included equal to 9. Therefore, the "Joker" is a wild tile for numerical values only. The "Joker" is limited to values that would not result in pair when combined with another tile.

Example: "2"+"Joker" ("7")=9; "Joker" is considered "7" in this combination which is called 9, "2" high.

"8"+"Joker" ("1")=9; "Joker" is considered "1" in this combination which is called 9, "8" high (red or white).

"5"+"Joker" ("4")=9; "Joker" is considered "4" in this combination which is called 9, "5" high (red or white).

When House Odds Standards will not permit making the "Joker" tile unrestricted except for making a pair, the "Joker" is limited to take on fewer values, for example two "wild" values. The same rules apply as noted above for the version where the "Joker" is unrestricted, except that a "Joker" tile can only be used as either one of only two predetermined numbers. For example, it can be used as either a "6" or "2", or it can be used as a "7" or "1", etc.

Example with "Joker" used as either a "6" or a "2" (deuce):

"7"+"Joker"("2")=9; "Joker" is considered "2" in this combination which is called 9, "7" high (red or white). This is the best combination for a natural "7".

"7"+"Joker" ("6")=3; "Joker" is considered "6" in this combination which is called 3, "7" high (red or white). This is the worst combination for a natural "7".

"1"+"Joker" ("6")=7; "Joker" is considered "6" in this combination which is called 7, "1" high. This is the best combination for a natural "1".

"1"+"Joker" ("2")=3; "Joker" is considered "2" in this combination which is called 3, "1" high. This is the worst combination for a natural "1".

The drawings and the foregoing description are not intended to represent the only forms of the invention in regard to the details of its construction and manner of operation. In fact, this apparatus and method can be adapted to a great many different situations. For example, departing from the rules of Pai Gow, GAME 2 can be played exactly as described above, except that the two comparisons between the Dealer's hands and those of the Players can be changed so that, in order to win, a Player must have his or her tiles arranged so that the high hand has a greater value than the Dealer's high hand but the low hand has a lesser value than the Dealer's low hand, and vice versa for the Dealer. Yet another alternative would require both a Player's or Dealer's high and low hands be the lowest in the comparison ranking to prevail. Finally, yet another alternative would require the "high" hand to rank lowest in the "high" hand comparison and the "low" hand to rank highest in the "low" hand comparison. Another variation on GAME 2 would be to remove the underlines on the "6" and "9" tiles so that a "6" can be played as a "6" or as a "9", and a "9" can be played as a "9" or as a "6" (as was described in connection with GAME 1 and shown in FIGS. 1–4). Changes in form and in the proportion of parts, as well as the substitution of equivalents, are contemplated as circumstances may suggest or render expedient; and although specific terms have been employed, they are intended in a generic and descriptive sense only and not for the purpose of limitation, the scope of the invention being delineated in the following claims:

What is claimed is:

1. A method of playing a game with a set of game pieces, each of a first plurality of which bears on a face thereof an indicia, and each of a second plurality of which bear on a face thereof a numeric designation, each game piece and each pair of game pieces being assigned a predetermined rank, said method comprising the steps of:

randomly shuffling all of said game pieces:

dealing four of said game pieces to a Dealer and at least one Player, said Dealer and said at least one Player each arranging their game pieces to form a higher ranking hand with two of said game pieces and a lower ranking hand with the other two of said four game pieces;

comparing the Dealer's higher ranking hand with the higher ranking hand of said at least one Player;

comparing the Dealer's lower ranking hand with the lower ranking hand of said at least one Player; and determining a game winner, wherein to prevail, said Dealer or said at least one Player must win both said first hand comparison and said second hand comparison; wherein:

said indicia on each of said first plurality of game pieces is comprised of the word "Joker" defining a first plurality of "Joker" game pieces:

each said hand is ranked between a lowest ranking hand and a highest ranking hand;

the highest ranking hand comprises two "Joker" game pieces;

said game pieces of said second plurality bearing numeric designations each have an integer value selected from the group consisting of 0, 1, 2, 3, 4, 5, 6, 7, 8, and 9; and said second plurality of game pieces comprises a first group of game pieces having an equal number of game pieces inscribed with each of the integer values 0, 1, 2, 4, 5, 7, 8, and 9, and a second group of game pieces having an equal number of game pieces inscribed with each of the integer values 0, 3, 4, 5, 6, 7, and 8.

2. The method of playing a game as claimed in claim 1, wherein the numeric designations of said first group of game pieces are of a first color, and the numeric designations of said second group of game pieces are of a second color.

3. The method of playing a game as claimed in claim 2, wherein:

in said comparing steps, a hand comprising a pair of game pieces from said first plurality each bearing an indicia prevails over a hand comprising a pair of game pieces from said second plurality bearing identical numeric designations, which prevails over a hand comprising a pair of game pieces from said second plurality bearing identical numeric designations of lower rank, which prevails over a hand comprising a pair of game pieces from said second plurality bearing numeric designations totaling 9, which prevails over a hand comprising a pair of game pieces from said second plurality bearing numeric designations totaling 9 and of lower rank, which prevails over a hand comprising a pair of game pieces from said second plurality bearing numeric designations totaling 8, such ranking hierarchy continuing progressively until the numeric designations of game piece pairs total 0, all hands totaling 0 being of equal rank; and when comparing a pair of game pieces bearing numeric designations totaling 1, 2, 3, 4, 5, 6, 7, 8, or 9, the game pieces of a first color rank higher than the game pieces of a second color for game piece pairs bearing identical numeric totals.

4. A set of tiles for a game in which each Player is initially dealt four tiles with the objective being for the Player to form two hands of two tiles each, said set of tiles comprising:

a first plurality of tiles each of which has the same indicia thereon;

a second plurality of tiles each of which has a numeric designation thereon of a first color; and a third plurality of tiles each of which has a numeric designation thereon of a second color; wherein:

each one of said first and second plurality of tiles has a numeric designations thereon selected from the group consisting of 0, 1. 2. 3, 4, 5, 6, 7, 8, and 9;

said second plurality of game pieces have an equal number of game pieces with the integer values 0, 1, 2, 4, 5, 6, 7, and 9 thereon; and said third plurality of game pieces have an equal number of game pieces with the integer values 0, 3, 4, 5, 6, 7, and 8 thereon.

* * * * *